US011405715B2

(12) United States Patent
Namba et al.

(10) Patent No.: US 11,405,715 B2
(45) Date of Patent: Aug. 2, 2022

(54) INFORMATION PROCESSING APPARATUS

(71) Applicant: SONY CORPORATION, Tokyo (JP)

(72) Inventors: Ryuichi Namba, Tokyo (JP); Makoto Akune, Tokyo (JP)

(73) Assignee: SONY CORPORATION, Tokyo (JP)

( * ) Notice: Subject to any disclaimer, the term of this patent is extended or adjusted under 35 U.S.C. 154(b) by 0 days.

(21) Appl. No.: 17/057,809

(22) PCT Filed: May 16, 2019

(86) PCT No.: PCT/JP2019/019456

§ 371 (c)(1),
(2) Date: Nov. 23, 2020

(87) PCT Pub. No.: WO2019/230411

PCT Pub. Date: Dec. 5, 2019

(65) Prior Publication Data

US 2021/0204052 A1 Jul. 1, 2021

(30) Foreign Application Priority Data

May 30, 2018 (JP) ..... JP2018-102991

(51) Int. Cl.
*H04R 1/10* (2006.01)
*H04R 1/04* (2006.01)
(Continued)

(52) U.S. Cl.
CPC ..... *H04R 1/1058* (2013.01); *H04R 1/04* (2013.01); *H04R 1/06* (2013.01); *H04R 1/2869* (2013.01)

(58) Field of Classification Search
CPC ..... H04R 1/1058; H04R 1/04; H04R 1/06; H04R 1/2869; H04R 2201/003;
(Continued)

(56) References Cited

U.S. PATENT DOCUMENTS

2006/0145570 A1* 7/2006 Ohbayashi ..... H04R 19/005 310/322
2009/0136068 A1 5/2009 Koo et al.
(Continued)

FOREIGN PATENT DOCUMENTS

CN 201286164 Y 8/2009
CN 101626532 A 1/2010
(Continued)

OTHER PUBLICATIONS

International Search Report and Written Opinion of PCT Application No. PCT/JP2019/019456, dated Aug. 6, 2019, 09 pages of ISRWO.
(Continued)

*Primary Examiner* — Kile O Blair
(74) *Attorney, Agent, or Firm* — Chip Law Group

(57) ABSTRACT

The present technology relates to an information processing apparatus configured to obtain high comfortability. The information processing apparatus includes a plurality of board portions, an acquisition unit placed on one of the board portions and configured to acquire information associated with a wearer, and a connection portion being flexible and configured to connect the board portion to another of the board portions. The present technology is applicable to wearable devices.

13 Claims, 24 Drawing Sheets

(51) Int. Cl.
*H04R 1/06* (2006.01)
*H04R 1/28* (2006.01)

(58) Field of Classification Search
CPC ..... H04R 2201/401; G06F 2203/04102; G06F 1/1615; G06F 3/0202; H04M 1/0247; H04M 2250/12
See application file for complete search history.

(56) References Cited

U.S. PATENT DOCUMENTS

| | | | |
|---|---|---|---|
| 2011/0096951 | A1 | 4/2011 | Lee et al. |
| 2012/0275621 | A1 | 11/2012 | Elko |
| 2016/0021742 | A1 | 1/2016 | Johnsson et al. |
| 2016/0344309 | A1 | 11/2016 | Otagiri et al. |
| 2017/0026728 | A1 | 1/2017 | Elko |
| 2017/0245036 | A1 | 8/2017 | Kuki et al. |
| 2018/0102030 | A1 | 4/2018 | Khoshkawa et al. |
| 2019/0329731 | A1* | 10/2019 | Davis ..... G01K 3/005 |

FOREIGN PATENT DOCUMENTS

| | | | |
|---|---|---|---|
| CN | 107079207 | A | 8/2017 |
| CN | 107943277 | A | 4/2018 |
| DE | 102007055385 | A1 | 6/2009 |
| DK | 0500988 | T3 | 7/1995 |
| DK | 2063666 | T3 | 7/2019 |
| DK | 2975915 | T3 | 10/2019 |
| EP | 0500988 | A1 | 9/1992 |
| EP | 2063666 | A2 | 5/2009 |
| EP | 2189004 | A1 | 5/2010 |
| EP | 2517481 | A2 | 10/2012 |
| EP | 2975915 | A1 | 1/2016 |
| EP | 3209027 | A1 | 8/2017 |
| EP | 3309802 | A1 | 4/2018 |
| JP | 2008-132010 | A | 6/2008 |
| JP | 2008132010 | A * | 6/2008 |
| JP | 2010-541455 | A | 12/2010 |
| JP | 2011-049752 | A | 3/2011 |
| JP | 2012-186669 | A | 9/2012 |
| JP | 2016-082595 | A | 5/2016 |
| JP | 2016-220349 | A | 12/2016 |
| JP | 2018-064450 | A | 4/2018 |
| KR | 10-2010-0007195 | A | 1/2010 |
| KR | 10-2017-0070087 | A | 6/2017 |
| KR | 10-2018-0040506 | A | 4/2018 |
| TW | M353596 | U | 3/2009 |
| TW | 201004383 | A | 1/2010 |
| TW | 201630431 | A | 8/2016 |
| WO | 2010/005142 | A1 | 1/2010 |
| WO | 2011/024397 | A1 | 3/2011 |
| WO | 2011/087770 | A2 | 7/2011 |
| WO | 2016/059804 | A1 | 4/2016 |

OTHER PUBLICATIONS

Extended European Search Report of EP Application No. 119811638.6, dated Oct. 15, 2021, 14 pages.
Partial Supplementary European Search Report of EP Application No. 19811638.6, dated Jul. 12, 2021, 11 pages.

* cited by examiner

FIG. 2

| | FRONT | BACK |
|---|---|---|
| MICROPHONE | FRONT-MOUNTED TYPE | BACK-MOUNTED TYPE |
| GPS MODULE | ○ | × |
| 9-AXIS SENSOR | ○ | ○ |
| MAIN CHIP | ○ | ○ |
| ANTENNA | ○ | × |
| LED, ETC. | ○ | × |
| OTHERS | ○ | ○ |
| SWITCH | ○ | × |

FIG.7

| WEARING POSITION | REQUIREMENT |
|---|---|
| BACK | IT IS NECESSARY TO HAVE SHAPE CAPABLE OF BENDING ALONG WITH MOVEMENT OF SHAPE OF BACK, AND EXTERIOR THAT IS FLEXIBLE TO SOME EXTENT |
| STOMACH/WAIST (RUBBER PORTION OF SHORTS) | IT IS NECESSARY TO HAVE SHAPE CAPABLE OF BENDING TO MATCH TRUNK, WHICH HAS AN ELLIPTICAL SHAPE, AND EXTERIOR THAT IS FLEXIBLE TO SOME EXTENT |
| COLLAR (FACE SIDE) | TO HAVE SHAPE MATCHING SHAPE OF COLLAR OF SHIRT, BOARD WIDTH EQUAL TO OR SMALLER THAN WIDTH OF COLLAR (APPROXIMATELY 1 CM), AND TWISTED STRUCTURE |
| LEG (IN SOCK, ETC.) | THERE ARE EFFECTS OF RADIUS OF BACK OF PART UNDER KNEE OR SHIN AND WHETHER SOCKS ARE SHORT SOCKS OR KNEE-HIGH SOCKS, AND IT IS ASSUMED THAT WEARER WEARS SOCKS PULLED UP IN MATCH |

INFORMATION PROCESSING APPARATUS

CROSS REFERENCE TO RELATED APPLICATIONS

This application is a U.S. National Phase of International Patent Application No. PCT/JP2019/019456 filed on May 16, 2019, which claims priority benefit of Japanese Patent Application No. JP 2018-102991 filed in the Japan Patent Office on May 30, 2018. Each of the above-referenced applications is hereby incorporated herein by reference in its entirety.

TECHNICAL FIELD

The present technology relates to an information processing apparatus, in particular, to an information processing apparatus configured to obtain high comfortability when worn.

BACKGROUND ART

For example, in reproducing content related to space, such as soccer matches or concerts, when sound at any listening position, that is, a sound field at any listening position in the space can be reproduced, highly-immersive content reproduction can be achieved.

To achieve such highly-immersive content reproduction, it is conceivable to employ, for example, a method that collects sound around moving bodies, such as players, with microphones themselves, or equipment including the microphones that are worn on the moving bodies.

For example, as a technology related to attaching microphones, there has been proposed a fixing apparatus for microphone connectors using a rubber elastic body (for example, see PTL 1). With the use of this fixing apparatus, a microphone can be easily attached to a table or the like and have favorable characteristics with respect to vibration and shock.

CITATION LIST

Patent Literature

[PTL 1]
Japanese Patent Laid-Open No. 2012-186669

SUMMARY

Technical Problem

However, with the above-mentioned technology, in a case where a device configured to acquire information associated with a wearer, such as a microphone configured to collect sound around a wearer, is worn on a human body, high comfortability cannot be obtained.

For example, with the fixing apparatus described in PTL 1, a microphone cannot be worn directly on a wearer.

Further, for example, as a method of mounting a microphone or the like on a human body, it is conceivable to mount, on a wearer, a casing housing a board mounted with a microphone or the like.

However, in this case, to prevent the board mounted with the microphone or the like from being damaged, it is necessary that the board be housed in the hard casing to be attached to the wearer. Then, even when the wearer attached with the casing moves, for example, the casing itself is not deformed, and the hard casing hits the wearer or makes the wearer hard to move, with the result that high comfortability cannot be obtained.

The present technology has been made in view of such circumstances, and can obtain high comfortability.

Solution to Problem

According to one aspect of the present technology, there is provided an information processing apparatus including a plurality of board portions, an acquisition unit placed on one of the board portions and configured to acquire information associated with a wearer, and a connection portion being flexible and configured to connect the board portion to another of the board portions.

In one aspect of the present technology, a plurality of board portions is provided, an acquisition unit configured to acquire information associated with a wearer is placed on one of the board portions, and the board portion is connected to another of the board portions by a flexible connection portion.

Advantageous Effects of Invention

According to one aspect of the present technology, it is possible to obtain high comfortability.

Note that, the effects described here are not necessarily limited, and may be any effect described in the present disclosure.

BRIEF DESCRIPTION OF DRAWINGS

FIG. 2 is a diagram illustrating restrictions on arrangement of elements and the like on a board.

FIG. 7 is a diagram illustrating wearing positions and the shapes of the rigid flexible board.

DESCRIPTION OF EMBODIMENTS

Now, embodiments to which the present technology is applied are described with reference to the drawings.

First Embodiment

<Configuration Example of Information Processing Apparatus>

The present technology relates to a wearable device for acquiring, for example, information associated with the voice, position, direction, and movement (motion) of a plurality of moving bodies in target space.

The wearable device described here is a device that includes ranging devices, for example, a GPS (Global Positioning System) module and a 9-axis sensor, a microphone, and the like, and is worn on each moving body. The present technology reduces the wearable device in size while satisfying restrictions on the arrangement of the parts. Further, the present technology can achieve high comfortability and thus enhance the usability, and enhance the vibration isolation property to achieve high-quality sound recording.

As an example of moving bodies on each of which the wearable device including the microphone and the ranging devices is worn, players of sports such as soccer are conceivable. Further, as a specific target of sound collection (recording), that is, content with sound, for example, Target (1) to Target (4) as described below are conceivable.

Target (1)

Recording of team sports

Target (2)

Recording in space in which performances such as musicals, operas, or plays are being held Target (3)

Recording in any space in concert venues or theme parks

Target (4)

Recording of bands such as orchestras or marching bands

For example, in Target (1) described above, players may be moving bodies, and the players may each wear the wearable device including the microphone and the ranging devices. In a similar manner, also in Target (2) to Target (4), performers or audience members may be moving bodies, and the performers or audience members may each wear the wearable device.

Here, the wearable device may be reduced in size as much as possible such that the wearable device does not affect a performance by the wearer and is not seen from the surroundings, and high-quality sound may be obtained even when the motion of the wearer is large. Note that, in the following, a case where moving bodies on each of which the wearable device including the microphone and the like is worn are humans such as sports players is described as an example.

Figure 1:
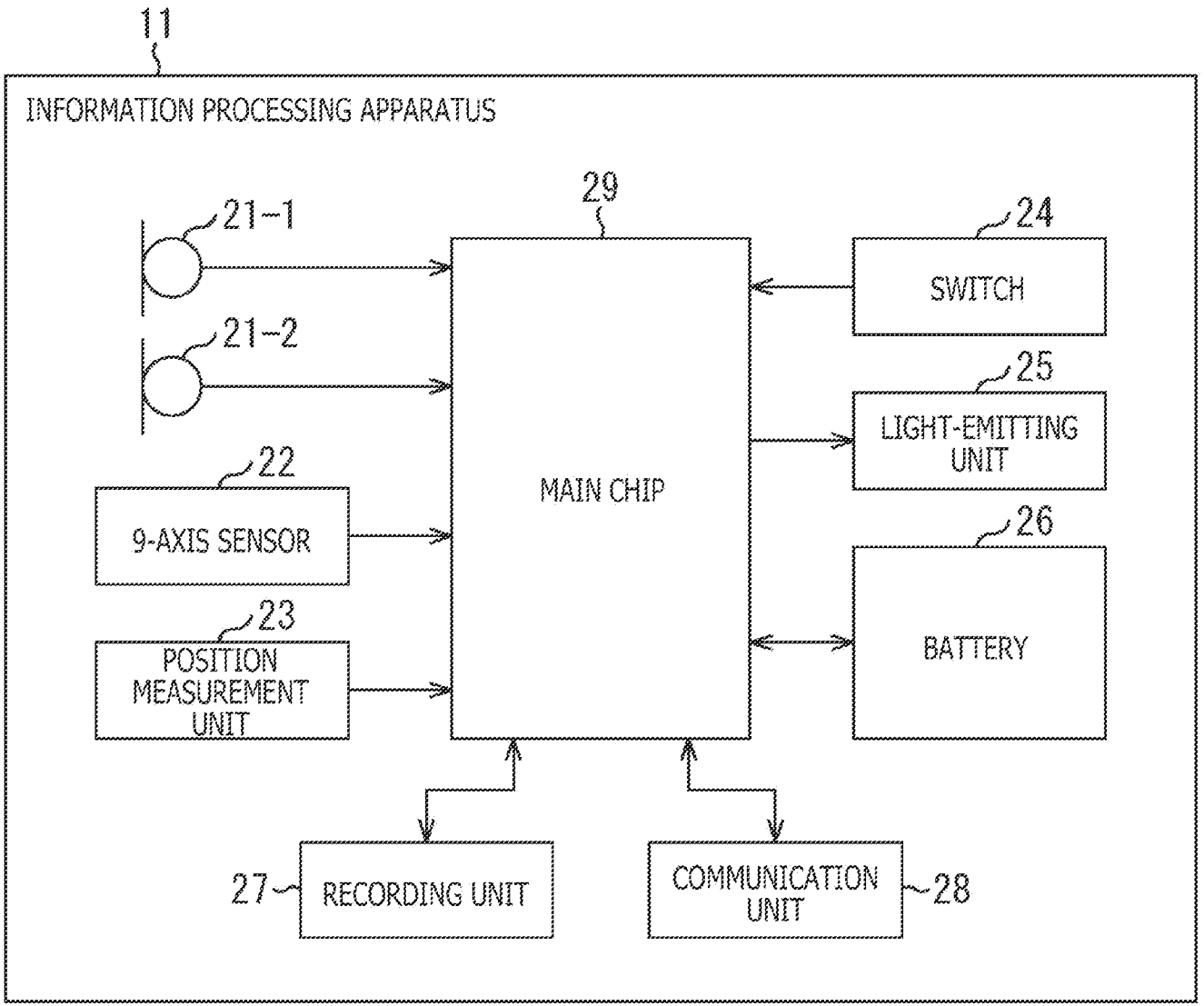
FIG. 1 is a diagram illustrating a functional configuration example of an information processing apparatus.

FIG. 1 is a diagram illustrating a functional configuration example of one embodiment of an information processing apparatus to which the present technology is applied.

An information processing apparatus 11 illustrated in FIG. 1 includes, for example, a wearable device that is worn on a human body, and acquires information associated with a wearer wearing the wearable device.

Here, the information associated with the wearer, which is to be acquired, is, for example, sound information regarding the voice of the wearer him/herself and sound around the wearer, wearer motion information regarding the movement speed, acceleration, and orientation indicating a movement direction of the wearer, or wearer position information.

The information processing apparatus 11 includes a microphone 21-1, a microphone 21-2, a 9-axis sensor 22, a position measurement unit 23, a switch 24, a light-emitting unit 25, a battery 26, a recording unit 27, a communication unit 28, and a main chip 29.

The microphone 21-1 and the microphone 21-2 collect surrounding sound such as the voice of the wearer, and supply voice signals obtained as a result to the main chip 29 as sound information. Note that, in the following, in a case where there is no particular need to distinguish between the microphone 21-1 and the microphone 21-2, the microphone 21-1 and the microphone 21-2 are also simply referred to as "microphone 21."

Note that, here, the example in which the two microphones 21 are provided to the information processing apparatus 11 is described, but the number of the microphones 21 is not limited thereto. Any number of the microphones 21 may be provided.

The 9-axis sensor 22 measures the movement speed and acceleration of the information processing apparatus 11, that is, the wearer wearing the information processing apparatus 11, a direction (orientation) that the wearer faces, and the like, and supplies the measurement results to the main chip 29 as motion information. Note that, here, the case where the device for acquiring motion information is the 9-axis sensor is described as an example, but besides that, an acceleration sensor, a gyro sensor, a geomagnetic sensor, a combination of those sensors, or the like may acquire motion information.

The position measurement unit 23 includes a position measurement module, for example, a GPS module or the like. The position measurement unit 23 measures the position of the wearer, and supplies the measurement result to the main chip 29 as position information.

The microphone 21, the 9-axis sensor 22, and the position measurement unit 23, which are described above, function as an acquisition unit configured to acquire information associated with the wearer, such as sound information, motion information, and position information.

The switch 24 includes, for example, a switch for turning on/off the information processing apparatus 11, and supplies signals based on operation by the wearer or the like to the main chip 29. The light-emitting unit 25 includes, for example, an LED (Light Emitting Diode), and emits light under control of the main chip 29.

The battery 26 is a power supply serving as the power source of the information processing apparatus 11, and supplies electric power to each part of the information processing apparatus 11 in response to an instruction or the like from the main chip 29.

The recording unit 27 includes a non-volatile removable recording medium or the like, and records various types of information such as sound information, motion information, and position information supplied from the main chip 29, or supplies recorded information to the main chip 29.

Note that, the recording unit 27 may be removably or unremovably mounted on the information processing apparatus 11. In the following, the description continues on the assumption that the recording unit 27 is removably mounted on the information processing apparatus 11.

The communication unit 28 includes, for example, a communication antenna for wireless communication, and communicates with an external apparatus. For example, the communication unit 28 wirelessly transmits various types of information such as sound information, motion information, and position information supplied from the main chip 29, or receives wirelessly transmitted various types of information to supply the various types of information to the main chip 29.

The main chip 29 includes a control unit, for example, a processor or the like, and controls the operation of the entire information processing apparatus 11.

For example, in response to signals supplied from the switch 24, the main chip 29 controls the battery 26 to supply electric power to each part of the information processing apparatus 11, or controls the light-emitting unit 25 to emit light.

Further, for example, the main chip 29 supplies, to the recording unit 27, various types of information such as sound information supplied from the microphone 21, motion information supplied from the 9-axis sensor 22, and position information supplied from the position measurement unit 23 so that the recording unit 27 records the various types of information. Alternatively, the main chip 29 supplies the various types of information to the communication unit 28 so that the communication unit 28 transmits the various types of information. Besides, the main chip 29 performs predetermined arithmetic processing on the basis of those pieces of information.

Incidentally, the information processing apparatus 11 includes the wearable device or the like that is worn on a human body.

In a case where it is assumed that the wearer of the information processing apparatus 11 moves, it is necessary that the information processing apparatus 11 provide highest possible comfortability as much as possible and do not prevent a performance by the wearer wearing the information processing apparatus 11.

To achieve high comfortability, it is necessary that the information processing apparatus 11 fit a wearing surface that is a curved surface or the like with no gap. That is, it is necessary that the shape of the information processing apparatus 11 be a shape that is not affected by body motion.

Further, it is necessary that the mixing of noise due to the effect of the information processing apparatus 11 being worn be avoided when information associated with the wearer such as sound information, motion information, and position information is acquired by the microphone 21, the 9-axis sensor 22, the position measurement unit 23, and the like.

For example, when the information processing apparatus 11 does not fit the wearer when being worn, the information processing apparatus 11 hits the body of the wearer every time the wearer moves, with the result that sound information obtained by the microphone 21 collecting sound is mixed with noise.

Accordingly, in the information processing apparatus 11, a board portion on which the microphone 21 and the like are mounted is divided into a plurality of parts, and the plurality of board portions after division is connected to each other by flexible connection portions having an electrical and physical connection function so that the information processing apparatus 11 can be closely mounted on a curved surface. With this, the effect of body motion can be minimized so that high comfortability can be obtained, and the effect of electrical noise can be reduced.

To obtain high comfortability and reduce the effect of noise, it is necessary to impose restrictions illustrated in FIG. 2, for example, on the arrangement of the parts of the microphone 21 and the like in mounting the microphone 21 and the like on the board portions.

Note that, in FIG. 2, the term "front surface" indicates the front surfaces of the board portions, and the term "back surface" indicates the back surfaces of the board portions. The front surface of a board portion is, of the opposite surfaces of the board portion, a surface that is positioned on the side opposite to the wearer when the information processing apparatus 11 is worn on the wearer. Further, the back surface of a board portion is, of the opposite surfaces of the board portion, a surface that is positioned on the wearer side when the information processing apparatus 11 is worn on the wearer.

For example, in a case where a front-mounted microphone is used as the microphone 21, the microphone 21 is placed on the front surface of a board portion, while in a case where a back-mounted microphone is used as the microphone 21, the microphone 21 is placed on the back surface of the board portion.

Further, since the signal reception sensitivities of the position measurement unit 23, which is the GPS module or the like, and the communication unit 28, which is the communication antenna or the like, drop when the units are arranged on the back surfaces of the board portions, it is necessary that the position measurement unit 23 and the communication unit 28 be arranged on the front surfaces of the board portions that are not brought in direct contact with the body of the wearer.

In a similar manner, it is necessary that the light-emitting unit 25 such as the LED that is to be seen by the wearer or the like and the switch 24 that is operated by the wearer or the like be arranged on the front surfaces of the board portions.

Meanwhile, the 9-axis sensor 22, the main chip 29, and the remaining elements may be arranged on the front surfaces of the board portions or the back surfaces of the board portions.

The elements (modules) of the information processing apparatus 11 are arranged on the board portions in a casing of the information processing apparatus 11 so that such restrictions are satisfied.

Figure 3:
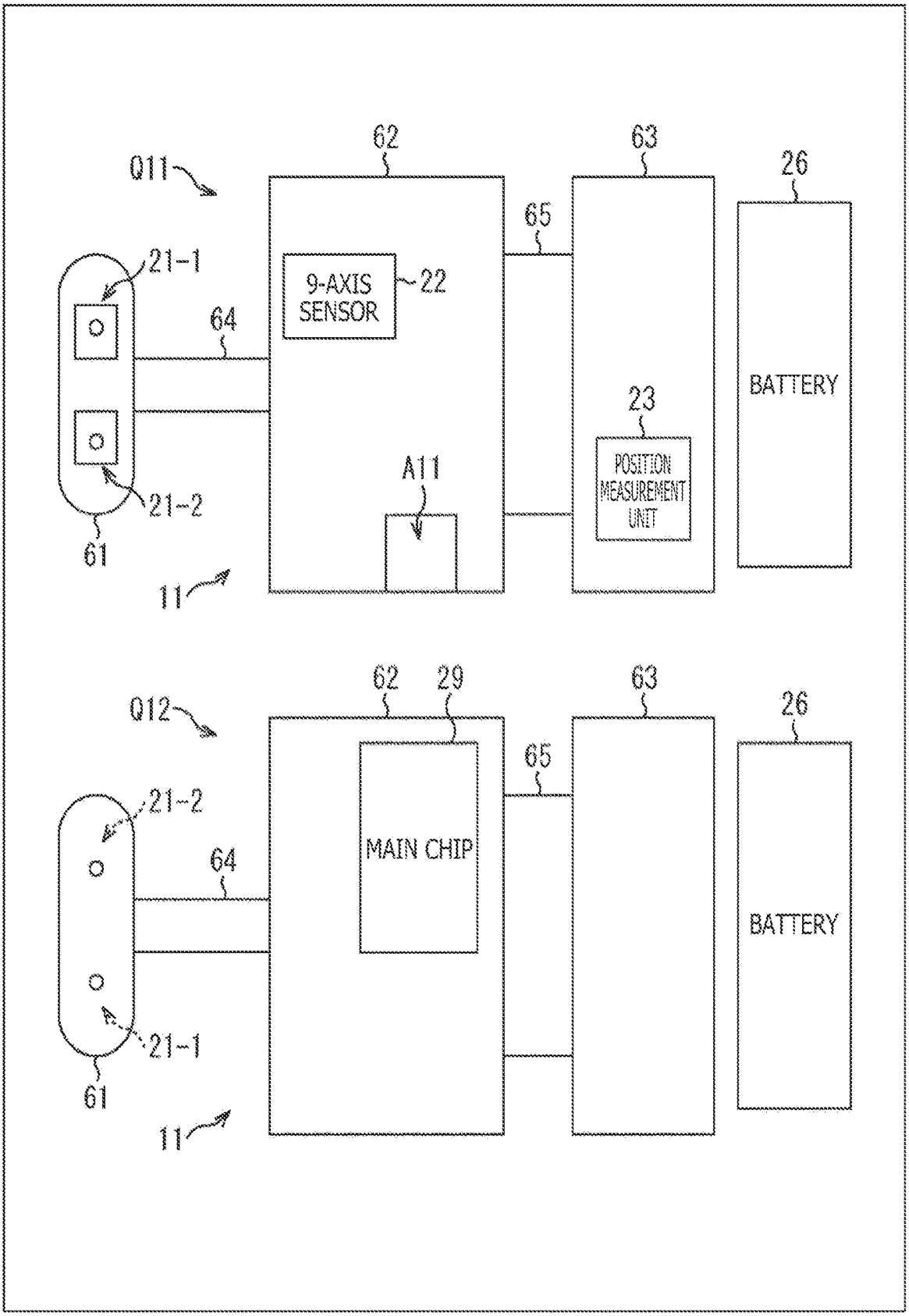
FIG. 3 is a diagram illustrating a mounting example of each element on the board.

Specifically, for example, the parts of the information processing apparatus 11 are arranged (mounted) on the board portions in an arrangement as illustrated in FIG. 3. Note that, in FIG. 3, portions corresponding to the ones in the case of FIG. 1 are denoted by the same reference signs, and the descriptions are appropriately omitted. However, in FIG. 3, the illustrations of some elements illustrated in FIG. 1 are omitted.

In the example illustrated in FIG. 3, inside the information processing apparatus 11, three board portions 61 to 63 are linearly arranged, and those board portions are connected to each other by a connection portion 64 and a connection portion 65.

In particular, in FIG. 3, in a portion indicated by an arrow Q11, the arrangement on the front surfaces of the board portions of the information processing apparatus 11 is illustrated, and in a portion indicated by an arrow Q12, the arrangement on the back surfaces of the board portions of the information processing apparatus 11 is illustrated.

The board portion 61 to the board portion 63 each at least include inflexible boards, for example, rigid boards or the like. Further, the connection portion 64 and the connection portion 65 each include flexible boards, for example, flexible printed boards including polyimide or the like.

More specifically, for example, the board portion 61 to the board portion 63 each include a laminate of board layers that are rigid boards or the like, and flexible board layers that are flexible printed boards or the like. In particular, some portions of the flexible printed boards serve as the board portion 61, the board portion 62, and the board portion 63, and the remaining portions serve as the connection portion 64 and the connection portion 65.

A board including the inflexible board portions 61 to 63 and the flexible connection portions 64 and 65 as described above is also called "rigid flexible board."

In the information processing apparatus 11, the board portion 61 is physically and electrically connected to the board portion 62 by the connection portion 64. In a similar manner, the board portion 62 is physically and electrically connected to the board portion 63 by the connection portion 65.

As indicated by the arrow Q11, the microphone 21 is placed on the front surface of the board portion 61 placed at the end farthest from the battery 26.

Further, the 9-axis sensor 22 is placed on the front surface of the board portion 62 placed between the board portion 61 and the board portion 63. Further, in a portion indicated by an arrow A11 on the front surface of the board portion 62, a slot for inserting the recording unit 27, which is removably mounted on the information processing apparatus 11, is provided. Note that, the recording unit 27 itself may be fixed (mounted) to the board portion 62.

Meanwhile, as indicated by the arrow Q12, the main chip 29 is placed on the back surface of the board portion 62.

Further, as indicated by the arrow Q11, the position measurement unit 23 is placed on the front surface of the board portion 63 positioned closest to the battery 26. In this example, for example, position information obtained through measurement by the position measurement unit 23 is supplied to the main chip 29 through the board portion 63, the connection portion 65, and the board portion 62.

In the information processing apparatus 11, the board portion 61 to the board portion 63 and the battery 26 are substantially linearly arranged. Such an arrangement is effective especially for a case where the information processing apparatus 11 is a watch, belt wearable device, or a wearable device that is worn on the back of a wearer.

Note that, the arrangement illustrated in FIG. 3 is merely an example, and the parts such as the microphone 21 and the main chip 29 may be arranged in any manner as long as the restrictions illustrated in FIG. 2 are satisfied.

<Enhancement of Comfortability>

Incidentally, in the information processing apparatus 11, to obtain high comfortability, the rigid flexible board, which includes the board portion 61 to the board portion 63, the connection portion 64, and the connection portion 65, is deformable.

Figure 4:
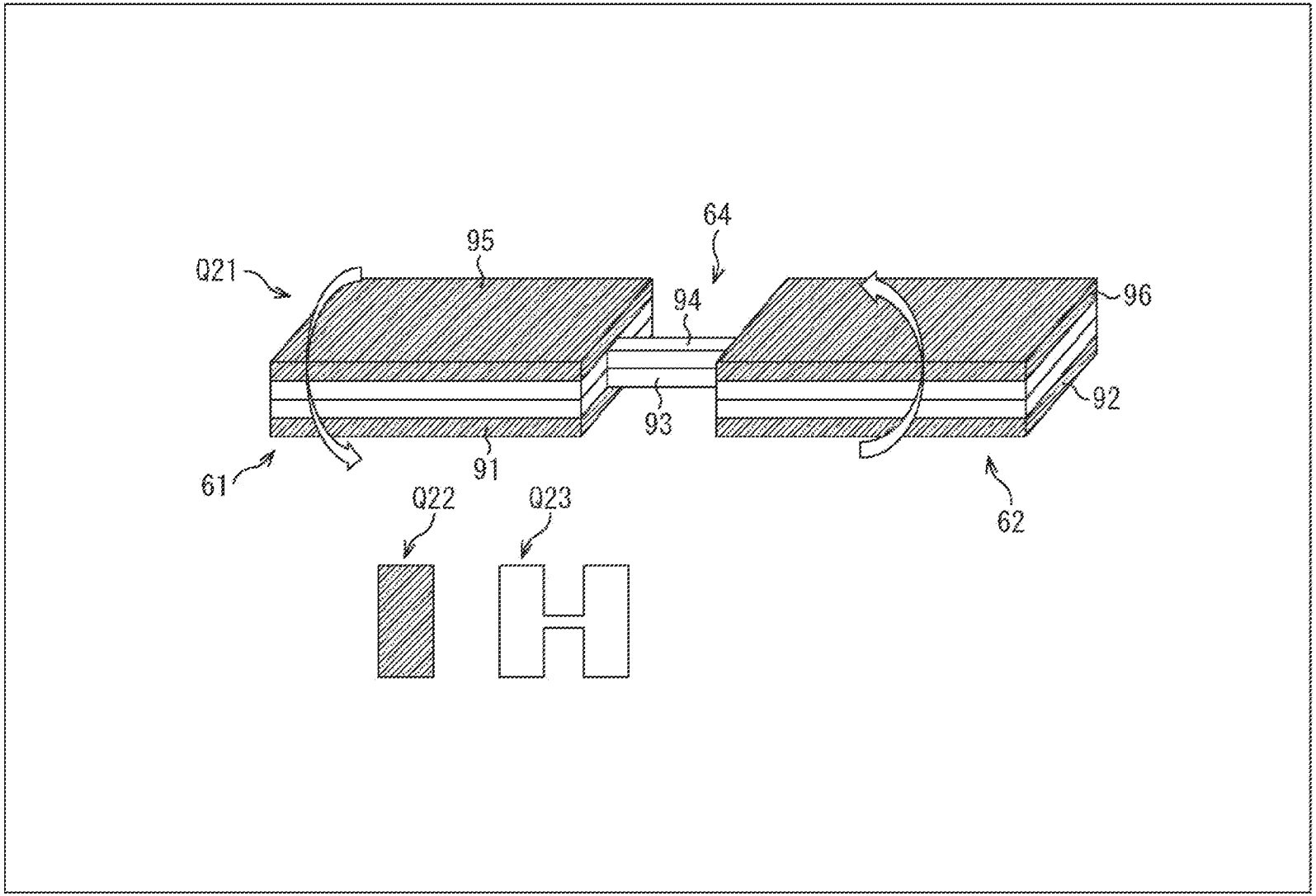
FIG. 4 is a diagram illustrating a configuration example of a rigid flexible board.

Specifically, for example, the portions of the board portion 61 and the board portion 62 each include the laminate of the flexible board layers and the inflexible board layers as illustrated in FIG. 4. Note that, in FIG. 4, portions corresponding to the ones in the case of FIG. 3 are denoted by the same reference signs, and the descriptions are appropriately omitted.

In the example illustrated in FIG. 4, as indicated by an arrow Q21, inflexible board layers 91 and 92 are provided at the bottom in FIG. 4, and a flexible board layer 93, which is a flexible board layer, is laminated on the board layer 91 and the board layer 92 in FIG. 4.

Further, a flexible board layer 94, which is flexible, is laminated on the flexible board layer 93 in FIG. 4, and inflexible board layers 95 and 96 are laminated on the flexible board layer 94 in FIG. 4.

Here, the board layer 91, the board layer 92, the board layer 95, and the board layer 96 have a rectangular shape as indicated by an arrow Q22. Meanwhile, the flexible board layer 93 and the flexible board layer 94 have a rectangular shape with depressions provided at its center portion as indicated by an arrow Q23. That is, the center portion of each of the flexible board layer 93 and the flexible board layer 94 is narrower than the end portions. The flexible board layer 93 and the flexible board layer 94 form the flexible printed boards.

In this example, the board portion 61 includes the board layer 91, the board layer 95, and part of each of the flexible board layer 93 and the flexible board layer 94. Thus, the board portion 61 is a part that is inflexible, that is, undeformable as a whole.

In a similar manner, the board portion 62 includes the board layer 92, the board layer 96, and part of each of the flexible board layer 93 and the flexible board layer 94. The board portion 62 is also not flexible as a whole.

Meanwhile, portions of the flexible board layer 93 and the flexible board layer 94 that are included in neither the board portion 61 nor the board portion 62, that is, narrow portions between the board portion 61 and the board portion 62 serve as the connection portion 64. The connection portion 64 is flexible and thus deformable.

Thus, for example, in a case where stress is applied to the rigid flexible board including the board portion 61, the board portion 62, the connection portion 64, and the like, the connection portion 64 and the connection portion 65 are deformed (bent). For example, the rigid flexible board can be deformed by receiving twisting force in directions indicated by the arrows in FIG. 4.

In this case, only the flexible portions such as the connection portion 64 and the connection portion 65 are deformed, and no load is applied to the inflexible portions such as the board portion 61 and the board portion 62. The rigid flexible board is therefore not damaged basically.

Thus, the casing, that is, exterior of the information processing apparatus 11 configured to house the rigid flexible board can include the deformable member.

The rigid flexible board and the exterior of the information processing apparatus 11 are made deformable as described above so that, when the wearer wearing the information processing apparatus 11 moves, the entire information processing apparatus 11 including the rigid flexible board is deformed along with the motion of the wearer. Thus, even when the wearer wearing the information processing apparatus 11 freely moves, the information processing apparatus 11 can keep fitting the wearer. That is, high comfortability can be obtained.

For example, in FIG. 4, in the case where the entire rigid flexible board is deformable in the arrow directions in a twisted manner, the information processing apparatus 11 can be worn on a part that receives twisting force such as the collar portion of a shirt of the wearer.

Further, on the flexible board layer 93 and the flexible board layer 94, signal lines, which are not illustrated, are formed. In addition, in the portion of the board portion 61 or the board portion 62, for example, wiring such as a via passing through the rigid flexible board from the board layer 91 to the board layer 95 can be formed.

The signal lines are formed on the flexible board layer 93 and the flexible board layer 94 as described above so that the parts mounted on the board layer 91, the board layer 92, the board layer 95, or the board layer 96, such as the microphone 21 and the main chip 29, are electrically connected to each other by the signal lines.

Note that, here, the rigid flexible board including the board portion 61, the board portion 62, the connection portion 64, and the like has the configuration in which the four board layers are laminated in the direction vertical to the board surface of the rigid flexible board. However, the rigid flexible board may include any number of board layers.

<Example of Board Configuration>

Further, in the example described above, the board portions and the connection portions of the information processing apparatus 11 are linearly arranged, but the arrangement of the board portions and connection portions, that is, the shape of the rigid flexible board is not limited to the example illustrated in FIG. 3 and may be any shape.

For example, the shape of the rigid flexible board may be a shape with the board portion 61 and the board portion 62 twisted in the directions of the arrows of FIG. 4. Further, the board portions of the information processing apparatus 11 may have one of shapes illustrated in FIG. 5, for example.

Figure 5:
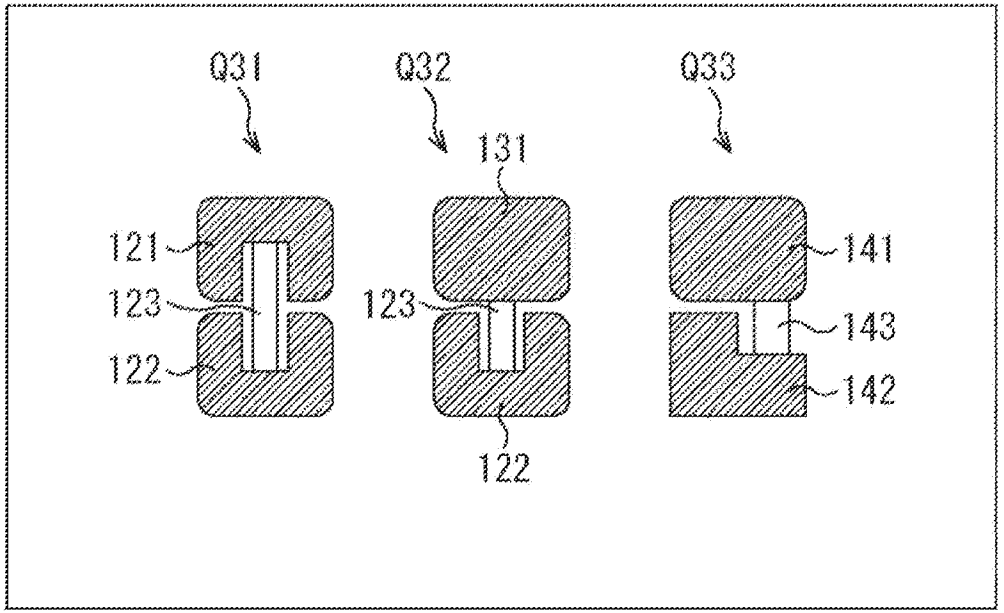
FIG. 5 is a diagram illustrating configuration examples of the rigid flexible board.

For example, in an example indicated by an arrow Q31 of FIG. 5, the information processing apparatus 11 of the rigid flexible board includes a board portion 121 and a board portion 122 that correspond to the board portion 61 and the like illustrated in FIG. 3, and a connection portion 123 corresponding to the connection portion 64 and the like illustrated in FIG. 3. The elements of the microphone 21 and the like are mounted on the front or back surfaces of the board portion 121 and the board portion 122.

The board portion 121 and the board portion 122 have a shape with a cut-out, that is, a recess shape. Specifically, the board portion 121 and the board portion 122 have a rectangular shape with a rectangular recess portion provided at its center portion.

Here, the board portion 121 has the recess portion provided at the center portion of its side facing the board portion 122. In a similar manner, the board portion 122 has the recess portion provided at the center portion of its side facing the board portion 121. Further, sides at positions farthest from each other of the recess portions, that is, portions opposite to each other of the recess portions, are connected to each other by the flexible connection portion 123.

In particular, here, there are provided gaps between the connection portion 123 and side portions adjacent to the connection portion 123 in the transverse direction in FIG. 5 of the recess portions of the board portion 121 and the board portion 122. Further, the connection portion 123 is surrounded by the board portion 121 and the board portion 122.

Thus, in this example, as compared to the example illustrated in FIG. 3, the connection portion 123, which is bendable (deformable), can be long. Further, since the board portion 121 and the board portion 122 can be arranged adjacent to each other, the length of the entire rigid flexible board can be shorter than the one in the example illustrated in FIG. 3. Moreover, in this example, also in the portions adjacent to the connection portion 123 in the transverse direction in FIG. 5 of the board portion 121 and the board portion 122, the elements of the information processing apparatus 11 such as the position measurement unit 23, can be arranged.

For example, in a case where a long connection portion is desired to secure a sufficient bend angle of the rigid flexible board, as in the example indicated by the arrow Q31, the portions of the board portions through which the flexible printed boards serving as the connection portions pass may be recessed. With this, sufficient bend angle and bend radius of the connection portions can be secured.

Further, the board portion 121 or the board portion 122 may have a rectangular shape instead of the recess shape. In such a case, for example, as indicated by an arrow Q32, a board portion 131 having the rectangular shape can be connected to the board portion 122 having the recess shape by the connection portion 123.

Moreover, for example, as indicated by an arrow Q33, a board portion 141 having the rectangular shape may be connected by a connection portion 143 to a board portion 142 having a shape with a cut-out in which a recess portion (cut-out) is provided near a corner of the rectangle.

In this example, the board portion 141 and the board portion 142 correspond to the board portion 61 and the like illustrated in FIG. 3 and are inflexible boards, and the connection portion 143 corresponds to the connection portion 64 and the like illustrated in FIG. 3 and is a flexible printed board that is flexible.

In particular, here, the rectangular recess portion is provided in the upper right portion of the board portion 142 in FIG. 5, and an end (side) portion opposite to the board portion 141 of the recess portion is connected to the board portion 141 by the connection portion 143. Also in this example, the board portion 141 is placed adjacent to the board portion 142 so that the rigid flexible board can be reduced in size, and the connection portion 143 can be sufficiently long.

Figure 6:
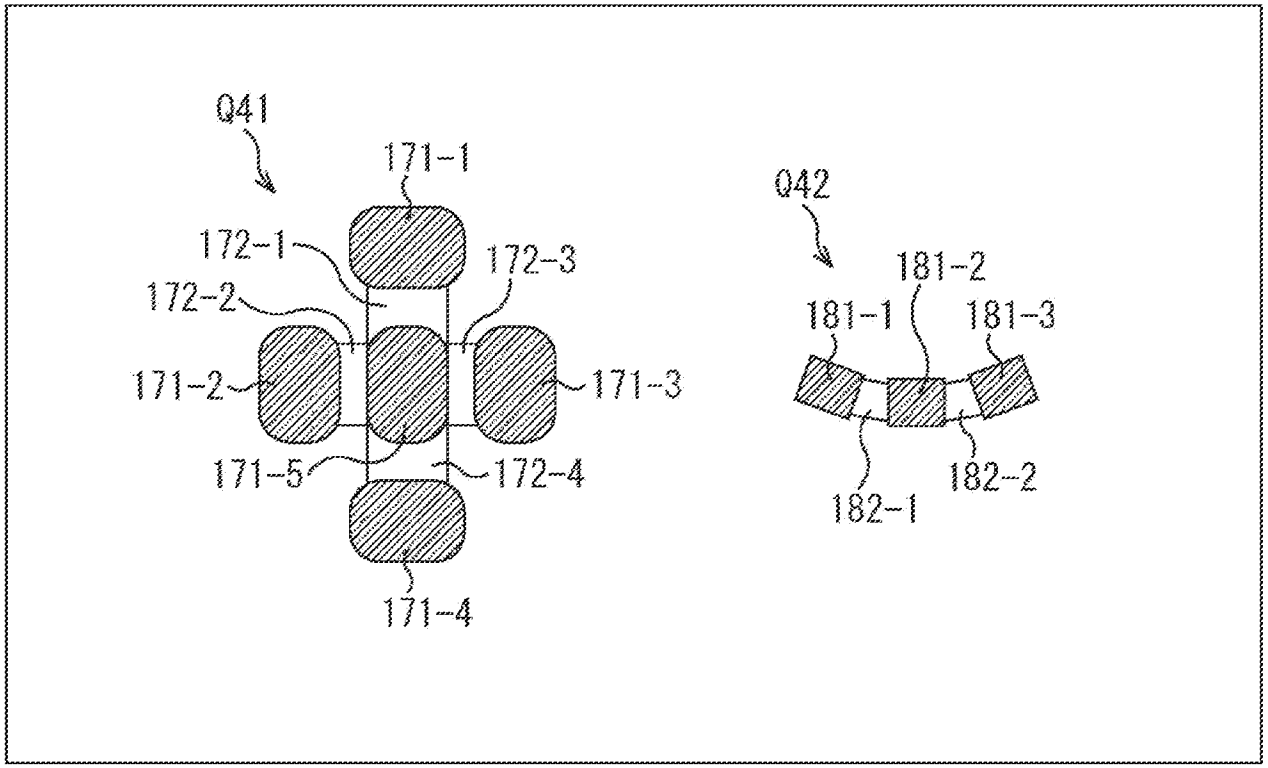
FIG. 6 is a diagram illustrating configuration examples of the rigid flexible board.

Besides, for example, as indicated by an arrow Q41 of FIG. 6, the information processing apparatus 11 of the rigid flexible board may have a cross shape.

In this example, the information processing apparatus 11 of the rigid flexible board includes rectangular board portions 171-1 to 171-5 corresponding to the board portion 61 and the like illustrated in FIG. 3, and a connection portion 172-1 to a connection portion 172-4 that correspond to the connection portion 64 and the like illustrated in FIG. 3.

That is, with the board portion 171-5 being the center, the board portion 171-1 is placed on the upper side, the board portion 171-4 is placed on the lower side, the board portion 171-2 is placed on the left side, and the board portion 171-3 is placed on the right side. Further, the board portion 171-1 to the board portion 171-4 are connected to the board portion 171-5 by the connection portion 172-1 to the connection portion 172-4.

The configuration of the rigid flexible board indicated by the arrow Q41 is useful especially for, for example, a case where the information processing apparatus 11 is worn on the head of a wearer such as a case where the information processing apparatus 11 is a headgear or helmet apparatus.

Further, the rigid flexible board may have a curve shape as indicated by an arrow Q42 of FIG. 6.

In this example, the information processing apparatus 11 of the rigid flexible board includes rectangular board portions 181-1 to 181-3 corresponding to the board portion 61 and the like illustrated in FIG. 3, and a connection portion 182-1 and a connection portion 182-2 that correspond to the connection portion 64 and the like illustrated in FIG. 3.

In particular, here, the board portion 181-1 to the board portion 181-3 are arranged in an arc shape. Further, the board portion 181-1 is connected to the board portion 181-2 by the connection portion 182-1, and the board portion 181-2 is connected to the board portion 181-3 by the connection portion 182-2. Such an arc-like rigid flexible board is useful especially for a case where the information processing apparatus 11 is worn on the collar portion of a shirt of a wearer, for example.

The shape of the information processing apparatus 11 of the rigid flexible board, that is, the arrangement of the board portions may depend on the shape of a part on which the information processing apparatus 11 is worn as illustrated in FIG. 7, for example.

That is, for example, in a case where the information processing apparatus 11 is worn on the back of the wearer, it is necessary that the information processing apparatus 11 of the rigid flexible board have shape and construction capable of being deformed (bent) along with the movement of the back of the wearer. In this case, it is necessary that the exterior portion of the information processing apparatus 11 be flexible to some extent.

Further, for example, in a case where the information processing apparatus 11 is worn on the stomach or waist of the wearer, specifically, the elastic waist portion of short shorts, shorts, or the like, it is necessary that the rigid flexible board have shape and construction capable of being deformed (bent) to match the trunk of the wearer, which has an elliptical shape. Also in this case, it is necessary that the exterior portion of the information processing apparatus 11 be flexible to some extent.

Moreover, for example, in a case where the information processing apparatus 11 is worn on the collar of a shirt that is placed under the face of the wearer, the width of the information processing apparatus 11 of the rigid flexible board may be set to match the shape of the collar, that is, have a width equal to or smaller than the width of the collar, for example, approximately 1 cm. In this case, the rigid flexible board may be configured to be twistable to match the shape of the collar or have a twisted shape.

Further, for example, in a case where the information processing apparatus 11 is worn on the leg portion of the wearer such as in a sock of the wearer, it is necessary that the information processing apparatus 11 have shape and structure capable of securing, depending on the shape of the back of the part under the knee or shin that is a wearing part, a bend radius corresponding to the radius of the wearing part. Note that, the shape and the structure of the information processing apparatus 11 are also affected by whether socks that the wearer wears are short socks or knee-high socks. Here, it is assumed that the wearer wears socks pulled up in a match or the like.

Moreover, for example, with the example illustrated in FIG. 3, the example in which the position measurement unit 23 is mounted on the board portion 63 placed adjacent to the battery 26 is described.

Figure 8:
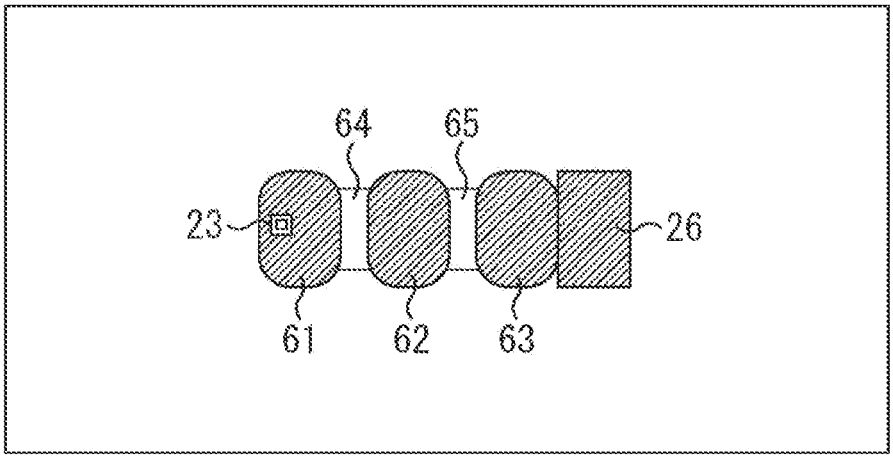
FIG. 8 is a diagram illustrating a placement example of a position measurement unit.

However, for example, as illustrated in FIG. 8, the position measurement unit 23 may be placed on the board portion 61 farthest from the battery 26. Note that, in FIG. 8, portions corresponding to the ones in the case of FIG. 3 are denoted by the same reference signs, and the descriptions are appropriately omitted.

In the example illustrated in FIG. 8, the position measurement unit 23 is placed on, of the board portion 61 to the board portion 63, the board portion 61 at the position farthest from the battery 26.

Since the GPS module, which is an example of the position measurement unit 23, handles weak signals, there is a fear of the mixing of power supply noise when the GPS module is close to the battery 26. That is, weak GPS radio waves are mixed with incoming noise in some cases.

Accordingly, in the example illustrated in FIG. 8, the position measurement unit 23 is placed on the board portion 61 at the position farthest from the battery 26 so that the mixing of power supply noise with the position measurement unit 23 is prevented. In other words, the position measurement unit 23 and the battery 26 are arranged at the opposite ends of the information processing apparatus 11 so that the mixing of power supply noise is to be avoided.

Further, the main chip 29, which always operates, and the position measurement unit 23 are arranged on different board portions at positions as far away from each other as possible so that the mixing of power supply noise with the position measurement unit 23 can be prevented.

Besides, separate power supply systems are provided for the GPS module serving as the position measurement unit 23 and the remaining elements so that the mixing of power supply noise may be prevented. In this case, for example, there are provided different circuits, namely, a power supply circuit configured to supply electric power from the battery 26 to the GPS module, and a power supply circuit configured to supply electric power from the battery 26 to the elements other than the GPS module.

With this, for example, even in the case where the position measurement unit 23 is positioned near the battery 26 as in the example illustrated in FIG. 3, the mixing of power supply noise can be prevented.

<Exterior of Information Processing Apparatus>

Incidentally, the exterior portion of the information processing apparatus 11 can be designed for each wearer.

For example, it is conceivable that the rigid flexible board including the board portion 61 to the board portion 63, the connection portion 64, and the connection portion 65 is manufactured as a general-purpose sound collector board, the rigid flexible board is worn on a wearing part of a wearer, and the exterior portion of the information processing apparatus 11 is customized to match the curved surface shape of the wearing part at that time. In this case, after the rigid flexible board is worn and wearer's measurements are taken for exterior portion creation, an exterior portion is created and the exterior portion (information processing apparatus 11) is actually worn on the wearer to be used. The above procedure may be repeated several times.

Here, the exterior portion may be made bendable (deformable) to some extent from a shape determined on the basis of the result of measurement. Further, in some cases, it may be assumed that some universal sized exterior portions are created in advance.

In this way, it is basically necessary that the exterior portion of the information processing apparatus 11 be bendable, that is, flexible to some extent.

Figure 9:
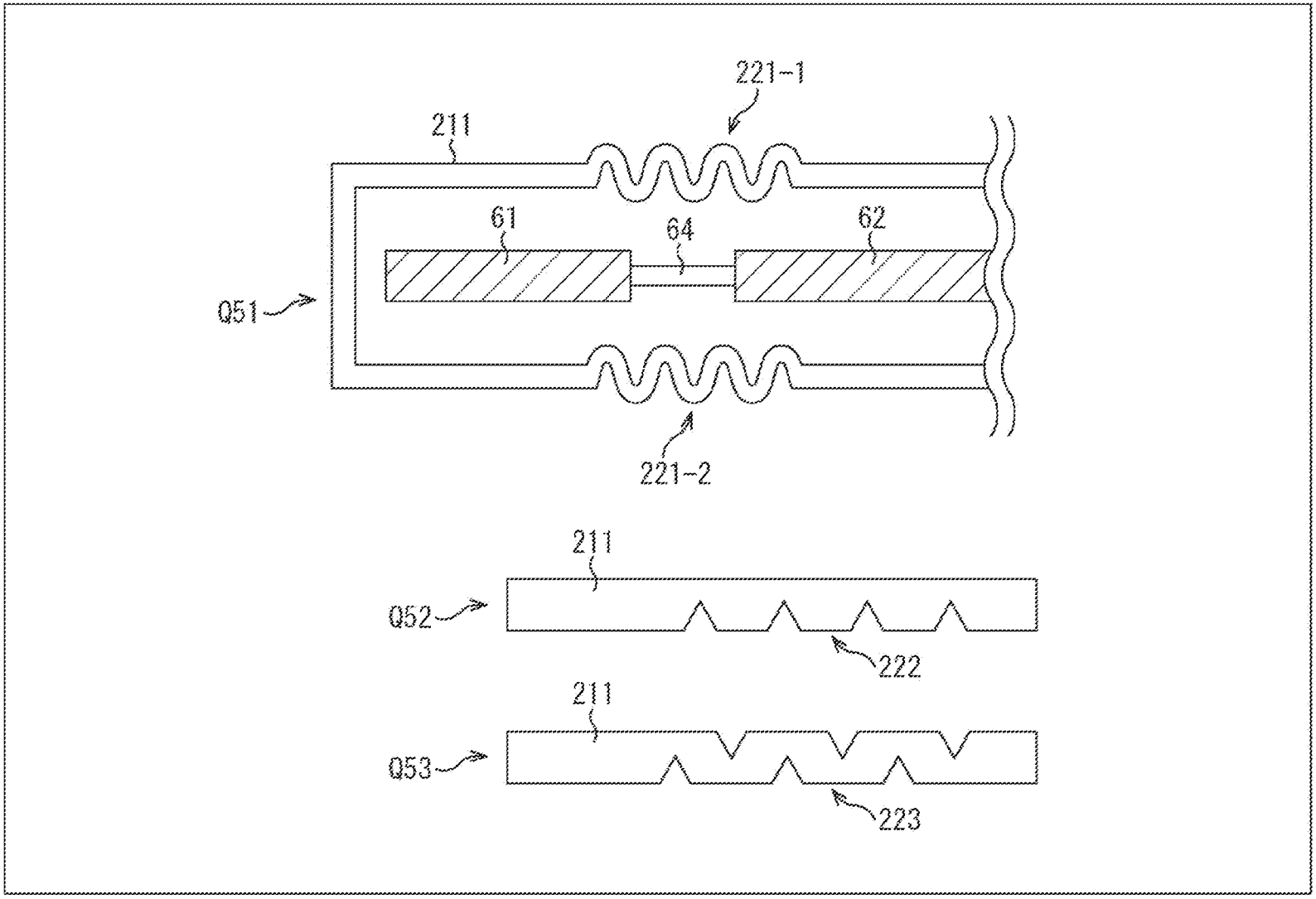
FIG. 9 is a diagram illustrating configuration examples of an exterior portion.

Accordingly, for example, the exterior portion of the information processing apparatus 11 is structured as illustrated in FIG. 9 so that the exterior portion is bendable. Note that, in FIG. 9, portions corresponding to the ones in the case of FIG. 3 are denoted by the same reference signs, and the descriptions are appropriately omitted.

In an example indicated by an arrow Q51 of FIG. 9, the information processing apparatus 11 includes an exterior portion 211 configured to cover the rigid flexible board including the board portion 61, the board portion 62, the connection portion 64, and the like.

The exterior portion 211 functions as the casing of the information processing apparatus 11. In this example, a deformable portion 221-1 and a deformable portion 221-2 that are portions opposite to the connection portion 64 of the exterior portion 211 have bellows structure. Note that, in the following, in a case where there is no particular need to distinguish between the deformable portion 221-1 and the deformable portion 221-2, the deformable portion 221-1 and the deformable portion 221-2 are also simply referred to as "deformable portion 221."

In particular, here, the deformable portion 221-2 side is the wearer side, and the deformable portion 221-1 side is the side far from the wearer.

For example, in a case where the wearer moves to arch the back with the information processing apparatus 11 worn on the back of the wearer, a surface portion opposite to the wearer of the deformable portion 221 is stretched, while a surface portion on the wearer side of the deformable portion 221 is shrunk so that the exterior portion 211 is deformed. In this case, the connection portion 64 is also deformed like the exterior portion 211.

The deformable portion 221, which is part of the exterior portion 211, has the bellows structure as described above so that the portion of the deformable portion 221 can be stretched or shrunk to be deformed. In particular, the deformable portion 221 is provided near the connection portion of the rigid flexible board on the exterior portion 211 so that the exterior portion 211 is deformed like the rigid flexible board, with the result that the rigid flexible board can be prevented from receiving too much load. Note that, not only the portion of the deformable portion 221, but also the entire exterior portion 211 may be flexible to some extent.

Further, the deformable portions of the exterior portion 211 are not limited to the bellows structure, and may have structure with notches as indicated by an arrow Q52 or an arrow Q53.

In the example indicated by the arrow Q52, the exterior portion 211 has a deformable portion 222. The deformable portion 222 has notches formed in a surface inside the information processing apparatus 11, that is, a surface on the rigid flexible board side. When stress is applied to the exterior portion 211, the portion of the deformable portion 222 is deformed.

Meanwhile, in the example indicated by the arrow Q53, the exterior portion 211 has a deformable portion 223. The deformable portion 223 has notches formed in not only a surface inside the information processing apparatus 11, but also a surface outside the information processing apparatus 11. When stress is applied to the exterior portion 211, the portion of the deformable portion 223 is deformed.

The deformable portions are provided at the portions near the connection portion of the exterior portion 211 as described above so that outward bending and inward bending of the information processing apparatus 11 can be supported, with the result that the comfortability of the information processing apparatus 11 can be enhanced.

<Sound Hole of Exterior Portion>

Further, the exterior portion 211 has a sound hole portion for taking sound to the microphone 21.

Figure 10:
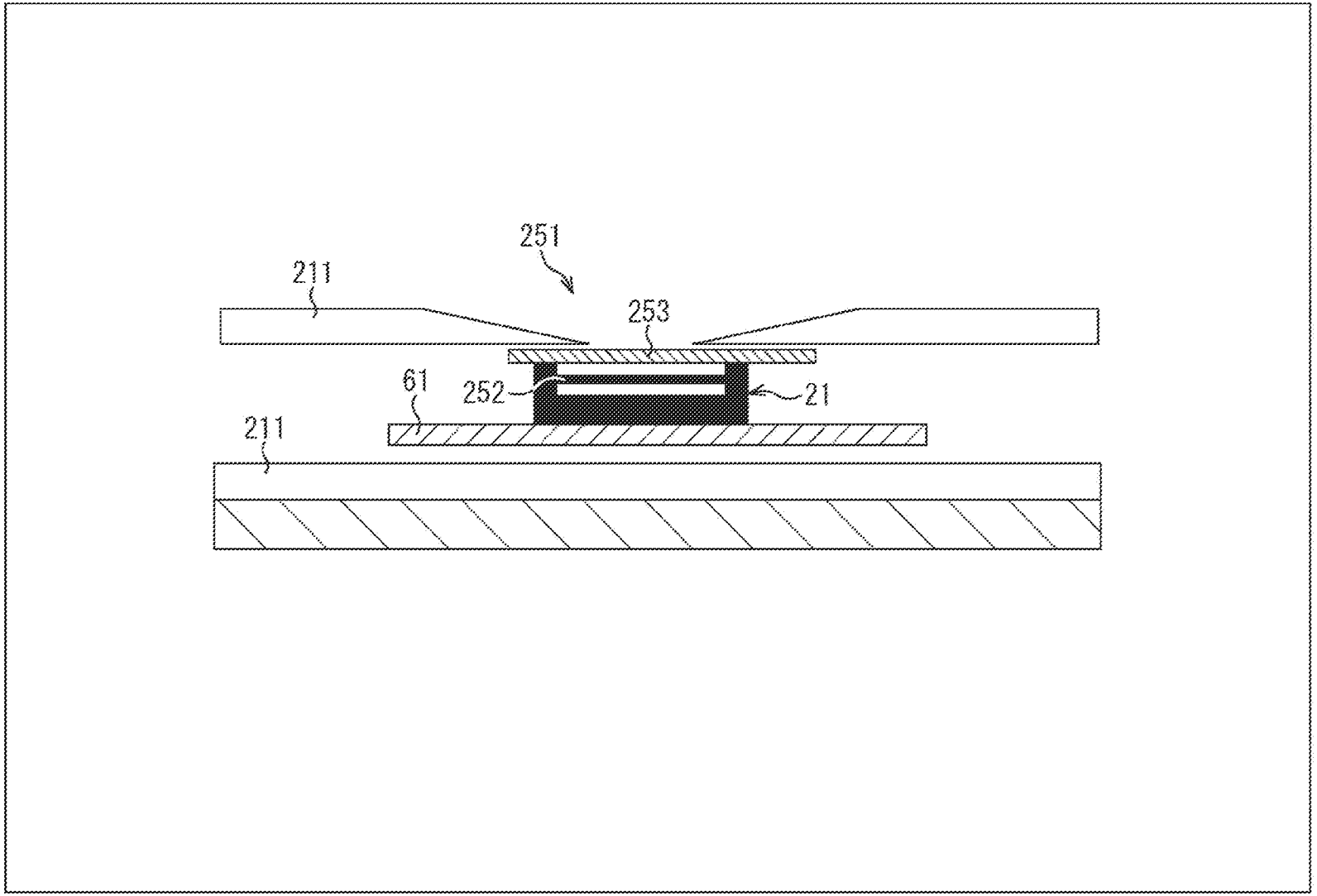
FIG. 10 is a diagram illustrating the configuration of a sound hole portion.

For example, in a case where priority is given to the acoustic characteristics of sound collected by the microphone 21, the exterior portion 211 may have a sound hole portion 251 that is tapered when seen from outside the information processing apparatus 11 as illustrated in FIG. 10, for example. Note that, in FIG. 10, portions corresponding to the ones in the case of FIG. 3 or FIG. 9 are denoted by the same reference signs, and the descriptions are appropriately omitted.

In the example illustrated in FIG. 10, the microphone 21 is placed on the front surface of the board portion 61, and the sound hole portion 251, which is a tapered sound hole, is formed in a portion opposite to a diaphragm 252 of the microphone 21 of the exterior portion 211.

That is, in the sound hole portion 251, the thickness of the exterior portion 211 is reduced toward the center position of the sound hole portion 251. In particular, in the sound hole portion 251, the height of the upper surface in FIG. 10, that is, surface outside the information processing apparatus 11 of the sound hole portion 251 (exterior portion 211) is reduced toward the center of the sound hole portion 251. At the center portion, the hole passing through the exterior portion 211 is formed.

Further, between the sound hole portion 251 and the diaphragm 252, a waterproof sheet 253 for preventing water or the like from entering the information processing apparatus 11 is placed.

The tapered sound hole portion 251 is provided as described above so that sound that arrives from more orientations can be led to the diaphragm 252 without being blocked by the exterior portion 211, and high quality sound with less noise can therefore be obtained at the microphone 21.

Figure 11:
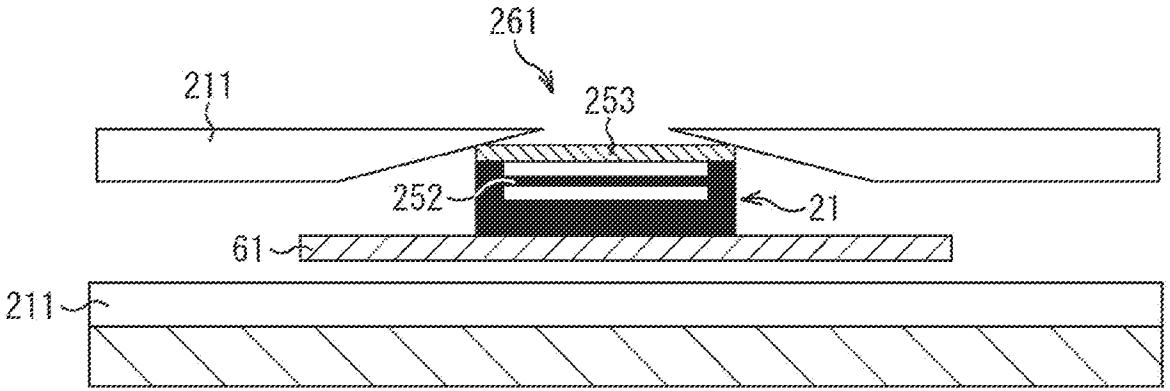
FIG. 11 is a diagram illustrating the configuration of a sound hole portion.

Further, in a case where priority is given to reducing the thickness of the entire information processing apparatus 11, a reverse tapered sound hole portion may be formed in the exterior portion 211 as illustrated in FIG. 11, for example. Note that, in FIG. 11, portions corresponding to the ones in the case of FIG. 10 are denoted by the same reference signs, and the descriptions are appropriately omitted.

In the example illustrated in FIG. 11, the microphone 21 is placed on the front surface of the board portion 61, and a sound hole portion 261, which is a reverse tapered sound hole, is formed in a portion opposite to the diaphragm 252 of the microphone 21 of the exterior portion 211. In other words, the sound hole portion 261 is a tapered sound hole when seen from inside the information processing apparatus 11.

In the sound hole portion 261, the thickness of the exterior portion 211 is reduced toward the center position of the sound hole portion 261. In particular, in the sound hole portion 261, the height of the lower surface in FIG. 11, that is, surface inside the information processing apparatus 11 of the sound hole portion 261 (exterior portion 211) is increased toward the center of the sound hole portion 261. At the center portion, the hole passing through the exterior portion 211 is formed.

Further, between the sound hole portion 261 and the diaphragm 252, the waterproof sheet 253 for preventing water or the like from entering the information processing apparatus 11 is placed.

The reverse tapered sound hole portion 261 is provided as described above so that, as compared to the example illustrated in FIG. 10, the diaphragm 252 can be placed at the position closer to the exterior of the information processing apparatus 11.

Further, the microphone 21 is fixed while being in abutment against the sound hole portion 261 so that, not only noise sound that is generated when the exterior portion 211 and the microphone 21 collide with each other due to the occurrence of vibration can be prevented, but also the thickness of the entire information processing apparatus 11 can be reduced.

<Fixing of Battery>

Figure 12:
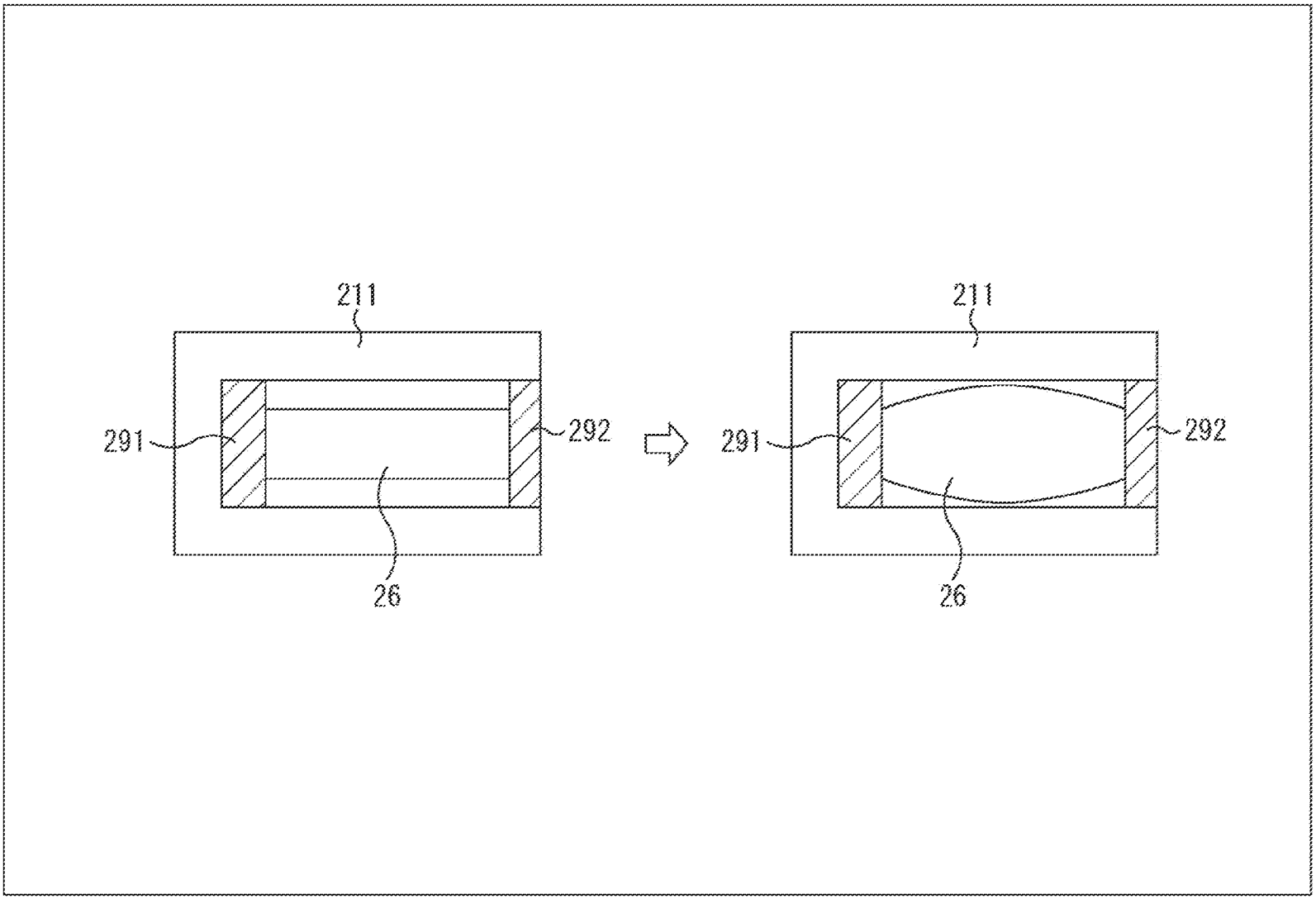
FIG. 12 is a diagram illustrating the fixing of a battery.

Moreover, in fixing the battery 26, for example, as illustrated in FIG. 12, the four corners of the battery 26 may be fixed to the exterior portion 211. Note that, in FIG. 12, portions corresponding to the ones in the case of FIG. 3 or FIG. 11 are denoted by the same reference signs, and the descriptions are appropriately omitted.

In the example illustrated in FIG. 12, the four corners of the battery 26 are fixed to the exterior portion 211 by a fixing portion 291 and a fixing portion 292.

The battery 26 is generally changed over time during use, and is deformed from a state illustrated on the left of FIG. 12 to a state illustrated on the right of FIG. 12. That is, in this example, the end portions of the battery 26 are not particularly greatly deformed, but the center portion of the battery 26 is expanded.

In this case, depending on how the battery 26 is fixed, the battery 26 is brought into contact with the exterior portion 211 or the battery 26 is shifted to be vibrated in some cases. Then, contact sound or vibration sound due to the battery 26 is generated.

Accordingly, in the example of FIG. 12, the end portions of the battery 26, which are not greatly deformed (expanded), are fixed to the exterior portion 211 by the fixing portion 291 and the fixing portion 292. With this, the battery 26 can be prevented from being brought into contact with the exterior portion 211, or vibrated.

<Vibration Isolation Structure around Microphone>

Further, the information processing apparatus 11 illustrated in FIG. 1 includes the microphone 21.

Thus, to obtain high quality sound with less noise, the information processing apparatus 11 has floating structure in which a board portion mounted with the microphone 21 is not directly in contact with the exterior portion or structure in which a vibration isolation member such as a vibration isolation gel is placed around the microphone 21.

Now, an example of such structure of the information processing apparatus 11 is described with reference to FIGS. 13 to 18. Note that, in FIGS. 13 to 18, portions corresponding to the ones in FIG. 1 or FIG. 11 are denoted by the same reference signs, and the descriptions are appropriately omitted. Further, in FIGS. 13 to 18, corresponding portions are denoted by the same reference signs, and the descriptions are appropriately omitted.

In addition, FIGS. 13 to 18 are sectional views when the information processing apparatus 11 is seen from the transverse direction. In FIGS. 13 to 18, the illustrations of some parts of the information processing apparatus 11 illustrated in FIG. 1 are omitted.

Figure 13:
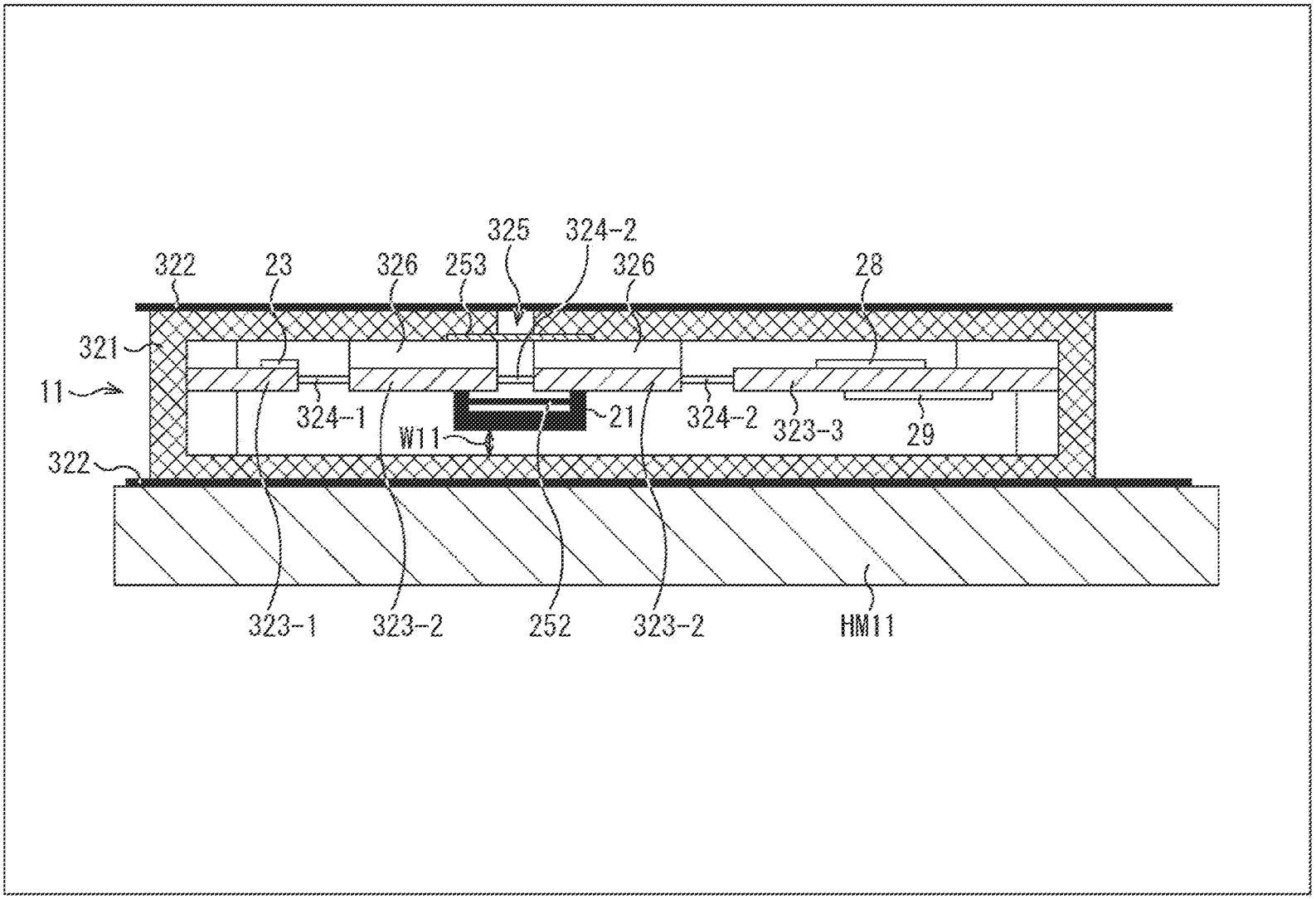
FIG. 13 is a diagram illustrating an example of the cross-sectional structure of the information processing apparatus.

In the example illustrated in FIG. 13, an exterior portion 321 that is the casing of the information processing apparatus 11 is fixed to a wearer HM11 (human body) by a fixing portion 322 such as a pocket for fixing the information processing apparatus 11 of clothes that the wearer is wearing.

Further, inside the exterior portion 321, a rigid flexible board including a board portion 323-1 to a board portion 323-3, a connection portion 324-1, and a connection portion 324-2 are fixed.

In particular, in this example, the three board portions 323-1 to 323-3 are linearly arranged.

Here, the board portion 323-1 to the board portion 323-3 each include board layers, for example, rigid boards and flexible board layers such as flexible printed boards, and correspond to the board portion 61 to the board portion 63 illustrated in FIG. 3. Note that, in the following, in a case where there is no particular need to distinguish between the board portion 323-1 to the board portion 323-3, the board portion 323-1 to the board portion 323-3 are also simply referred to as "board portion 323." The board portion 323 is not flexible as a whole.

Further, the connection portion 324-1 and the connection portion 324-2 each include flexible boards, for example, flexible printed boards including polyimide or the like, and correspond to the connection portion 64 and the connection portion 65 illustrated in FIG. 3. Note that, in the following, in a case where there is no particular need to distinguish between the connection portion 324-1 and the connection portion 324-2, the connection portion 324-1 and the connection portion 324-2 are also simply referred to as "connection portion 324."

In the information processing apparatus 11 illustrated in FIG. 13, the position measurement unit 23 is placed on the front surface of the board portion 323-1, one end of the board portion 323-1 is fixed to the end of the exterior portion 321, and the other end of the board portion 323-1 is connected to the board portion 323-2 by the connection portion 324-1.

Further, the board portion 323-2, which is positioned at the center of the three board portions 323, is connected to the board portion 323-1 by the connection portion 324-1 and to the board portion 323-3 by the connection portion 324-2.

Moreover, an end opposite to the connection portion 324-2 of the board portion 323-3 is fixed to the end of the exterior portion 321. The communication unit 28 is placed on the front surface of the board portion 323-3, and the main chip 29 is placed on the back surface of the board portion 323-3.

Further, a cut-out or hole is formed in part of the board portion 323-2, and the microphone 21 is placed so that the diaphragm 252 is exposed from the cut-out or hole portion. In particular, here, the microphone 21 is placed on the back surface of the board portion 323-2.

Moreover, a sound hole portion 325 is formed in a portion opposite to the board portion 323-2 of the exterior portion 321, and a vibration isolator 326, which is a gel or the like for vibration isolation, is placed between the front surface of the board portion 323-2 and the exterior portion 321. Further, in the portion of the sound hole portion 325, the waterproof sheet 253 is also placed between the vibration isolator 326 and the exterior portion 321.

The vibration isolator 326 is placed adjacent to the board portion 323-2 so that the board portion 323-2 is prevented from being greatly vibrated when the information processing apparatus 11 is vibrated, and the mixing of noise sound, such as vibration sound or contact sound, at the microphone 21 can therefore be prevented.

Although the microphone 21 is placed on the back surface of the board portion 323-2, the cut-out or hole formed in the board portion 323-2 provides space in which nothing shields the microphone 21 from the diaphragm 252 of the microphone 21 to the waterproof sheet 253.

The information processing apparatus 11 configured as described above is designed so that the distance from the sound hole portion 325 to the diaphragm 252 is minimum, and the thickness of the information processing apparatus 11 in the vertical direction in FIG. 13 is desirably as small as possible.

Further, the exterior portion 321 of the information processing apparatus 11 is flexible to some extent. That is, the exterior portion 321 is deformable (bendable) to some extent.

Moreover, to prevent the microphone 21 from being brought into contact with the exterior portion 321 when the entire information processing apparatus 11 is bent, that is, deformed, or when the information processing apparatus 11 is vibrated, it is necessary that a distance W11 from the microphone 21 to the exterior portion 321 be a sufficient distance.

For example, when the information processing apparatus 11 is vibrated, the exterior portion 321 and the board portion 323-2 are also vibrated. Here, the board portion 323-2 and the microphone 21 are arranged with play so that the board portion 323-2 and the microphone 21 can be freely vibrated in the amplitude range of vibration without being brought into contact with the exterior portion 321. Specifically, for example, the microphone 21 is mounted on the board portion 323-2 while the sufficient distance W11 is secured.

Figure 14:
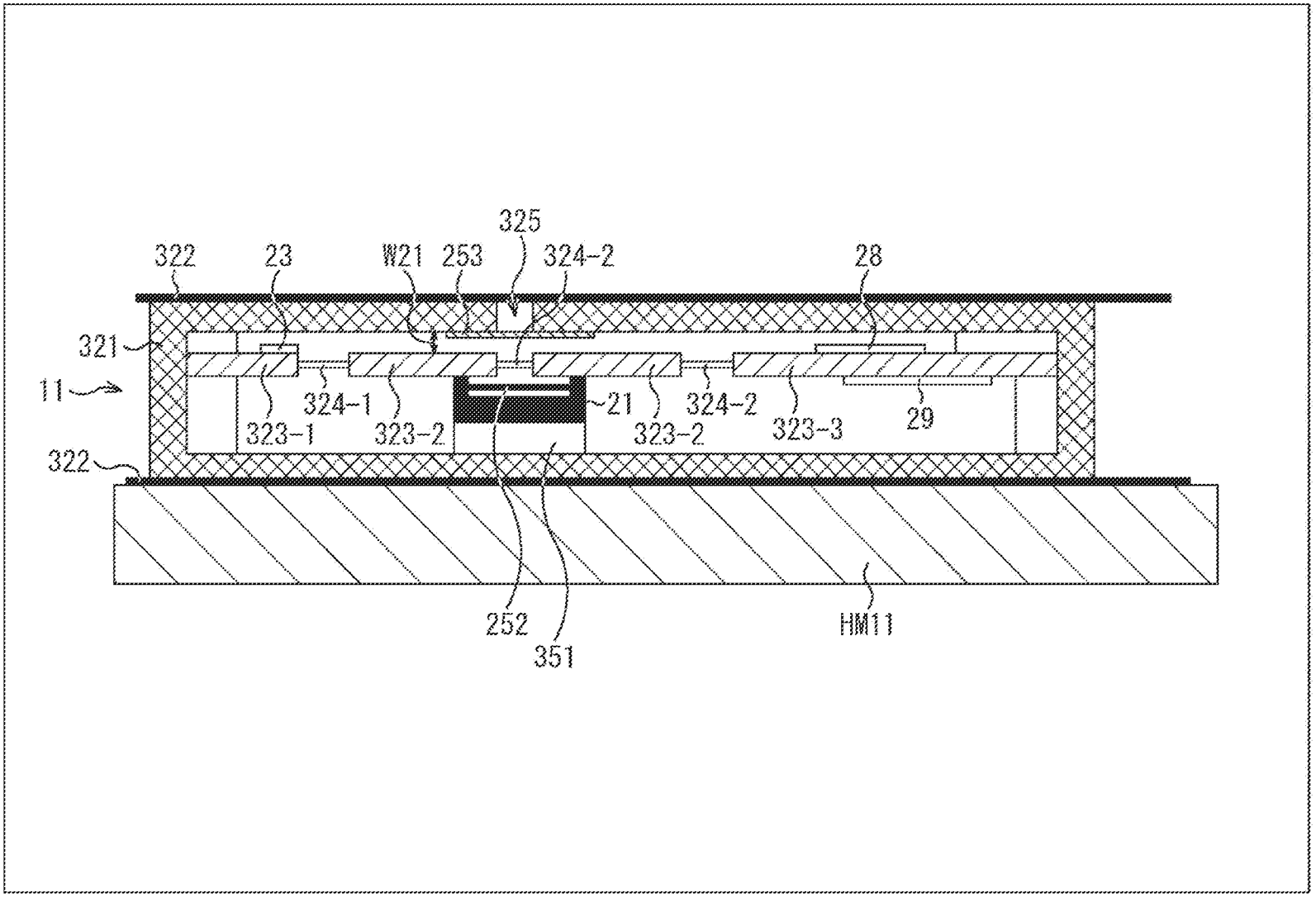
FIG. 14 is a diagram illustrating an example of the cross-sectional structure of the information processing apparatus.

Further, in the example illustrated in FIG. 14, the microphone 21 is placed on the back surface of the board portion 323-2 similarly to the case of FIG. 13, but the vibration isolator 326 is not provided on the front surface of the board portion 323-2.

However, in the example of FIG. 14, a vibration isolator 351 is provided between the microphone 21 and the wearer HM11-side surface of the exterior portion 321 so that the microphone 21 is prevented from being greatly vibrated when the information processing apparatus 11 is vibrated.

The vibration isolator 351 is placed adjacent to the microphone 21 so that the microphone 21 is prevented from being greatly vibrated when the information processing apparatus 11 is vibrated, and the mixing of noise sound can therefore be prevented.

The information processing apparatus 11 configured as described above is designed so that the distance enough to prevent the microphone 21 from being brought into contact with the waterproof sheet 253 when the entire information processing apparatus 11 is bent, that is, deformed, or when the information processing apparatus 11 is vibrated is secured, and the distance from the sound hole portion 325 to the diaphragm 252 is minimum.

Further, the thickness of the information processing apparatus 11 in the vertical direction in FIG. 14 is desirably as small as possible, and the exterior portion 321 of the information processing apparatus 11 is flexible to some extent.

In addition, the board portion 323-2 is placed with play so that, when the entire information processing apparatus 11 is bent or the information processing apparatus 11 is vibrated, the board portion 323-2 can be freely vibrated in the amplitude range of vibration without being brought into contact with the exterior portion 321. Specifically, for example, the board portion 323-2 is placed while a sufficient distance W21 is secured.

Figure 15:
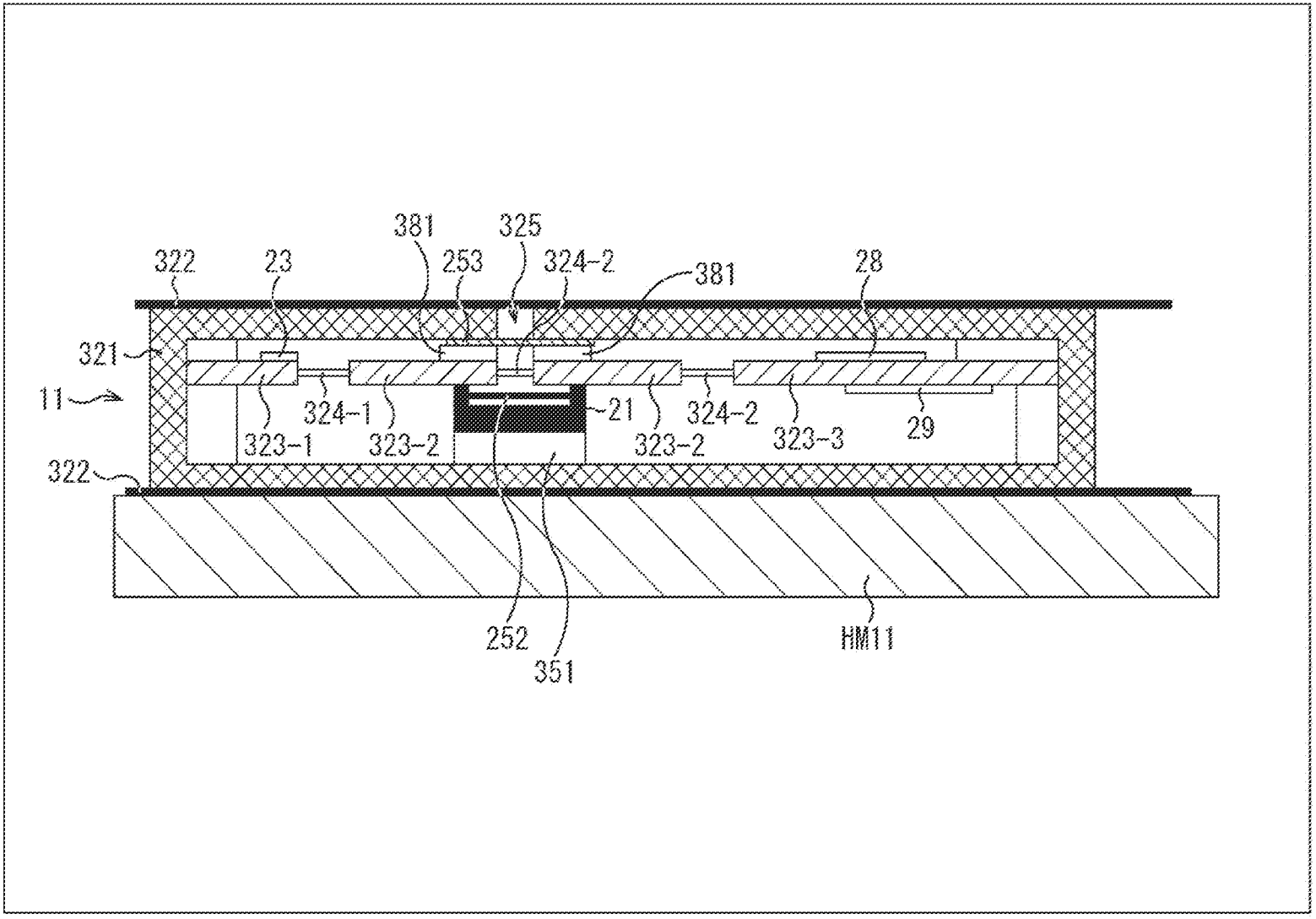
FIG. 15 is a diagram illustrating an example of the cross-sectional structure of the information processing apparatus.

In the example illustrated in FIG. 15, similarly to the case of FIG. 14, the microphone 21 is placed on the back surface of the board portion 323-2, and the vibration isolator 351 is provided between the microphone 21 and the exterior portion 321.

In the example of FIG. 15, in addition to this, a vibration isolator 381 is placed on the exterior portion 321, more specifically, between the waterproof sheet 253 and the board portion 323-2.

The vibration isolator 351 and the vibration isolator 381 as described above are arranged so that the microphone 21 and the board portion 323-2 are prevented from being greatly vibrated when the information processing apparatus 11 is vibrated, and the mixing of noise sound can therefore be prevented.

The information processing apparatus 11 configured as illustrated in FIG. 15 is designed so that the distance from the sound hole portion 325 to the diaphragm 252 is minimum, and the thickness of the information processing apparatus 11 in the vertical direction in FIG. 15 is desirably as small as possible. Further, the exterior portion 321 of the information processing apparatus 11 is flexible to some extent.

In addition, the board portion 323-2 is placed with play so that, when the entire information processing apparatus 11 is bent or the information processing apparatus 11 is vibrated, the board portion 323-2 can be freely vibrated in the amplitude range of vibration without being brought into contact with the exterior portion 321. Specifically, for example, sufficient distances are secured from the upper surface of the board portion 323-2 in FIG. 15 to the exterior portion 321 and the waterproof sheet 253.

Figure 16:
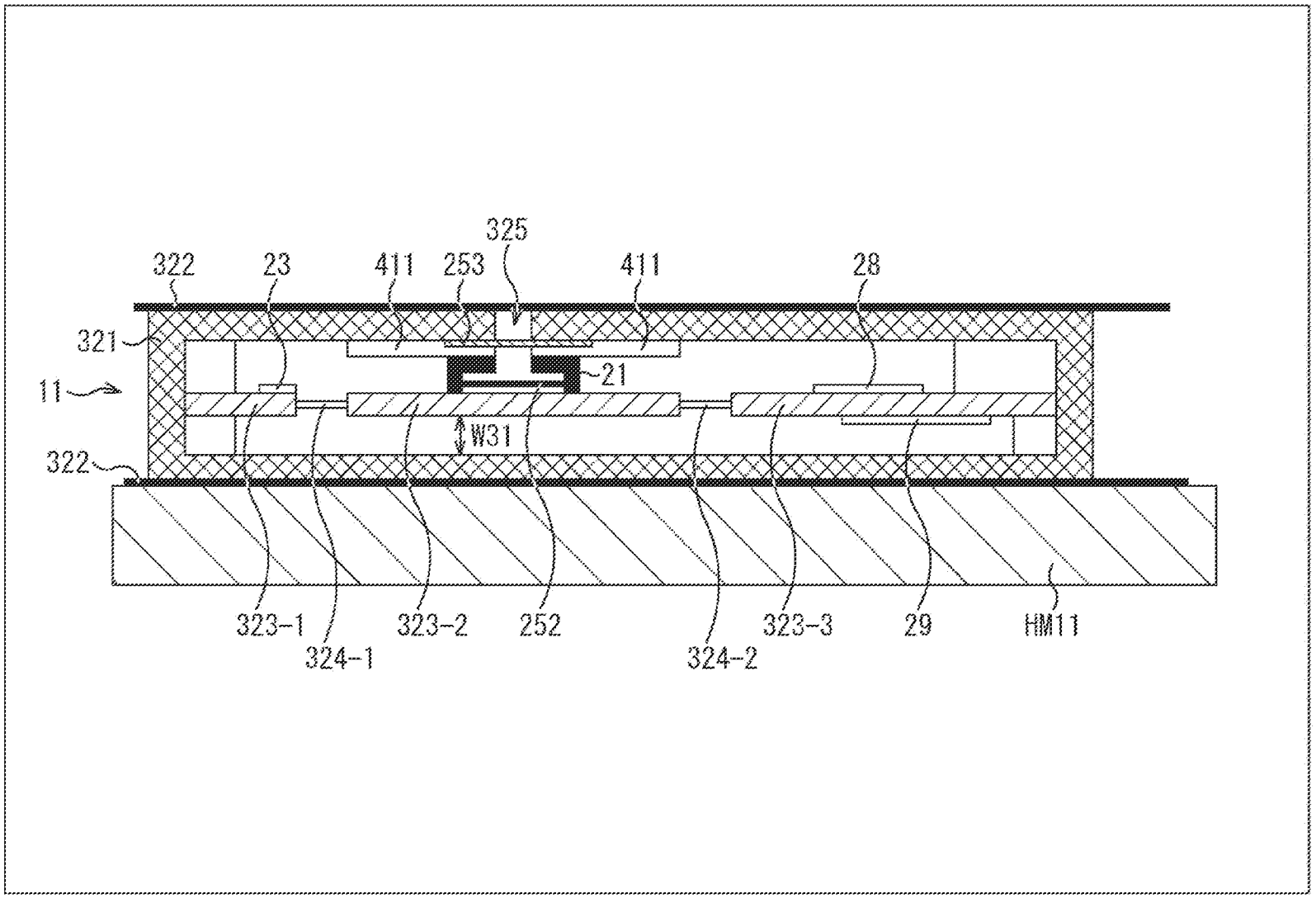
FIG. 16 is a diagram illustrating an example of the cross-sectional structure of the information processing apparatus.

Further, in the example illustrated in FIG. 16, the microphone 21 is placed on the front surface of the board portion 323-2, and a vibration isolator 411 is provided between the microphone 21 and the exterior portion 321. More specifically, in a portion near the sound hole portion 325, the waterproof sheet 253 is also placed between the vibration isolator 411 and the exterior portion 321.

The vibration isolator 411 as described above is placed so that the microphone 21 is prevented from being greatly vibrated when the information processing apparatus 11 is vibrated, and the mixing of noise sound can therefore be prevented. Note that, in the example of FIG. 16, no vibration isolator is placed between the back surface of the board portion 323-2 and the exterior portion 321.

The information processing apparatus 11 configured as illustrated in FIG. 16 is designed so that the distance from the sound hole portion 325 to the diaphragm 252 is minimum, and the thickness of the information processing apparatus 11 in the vertical direction in FIG. 16 is desirably as small as possible. Further, the exterior portion 321 of the information processing apparatus 11 is flexible to some extent.

In addition, the board portion 323-2 is placed with play so that, when the entire information processing apparatus 11 is bent or the information processing apparatus 11 is vibrated, the board portion 323-2 can be freely vibrated in the amplitude range of vibration without being brought into contact with the exterior portion 321.

That is, it is necessary that a distance W31 from the board portion 323-2 to the exterior portion 321 be long enough to prevent the board portion 323-2 from being brought into contact with the exterior portion 321 when the entire information processing apparatus 11 is deformed or vibrated.

Figure 17:
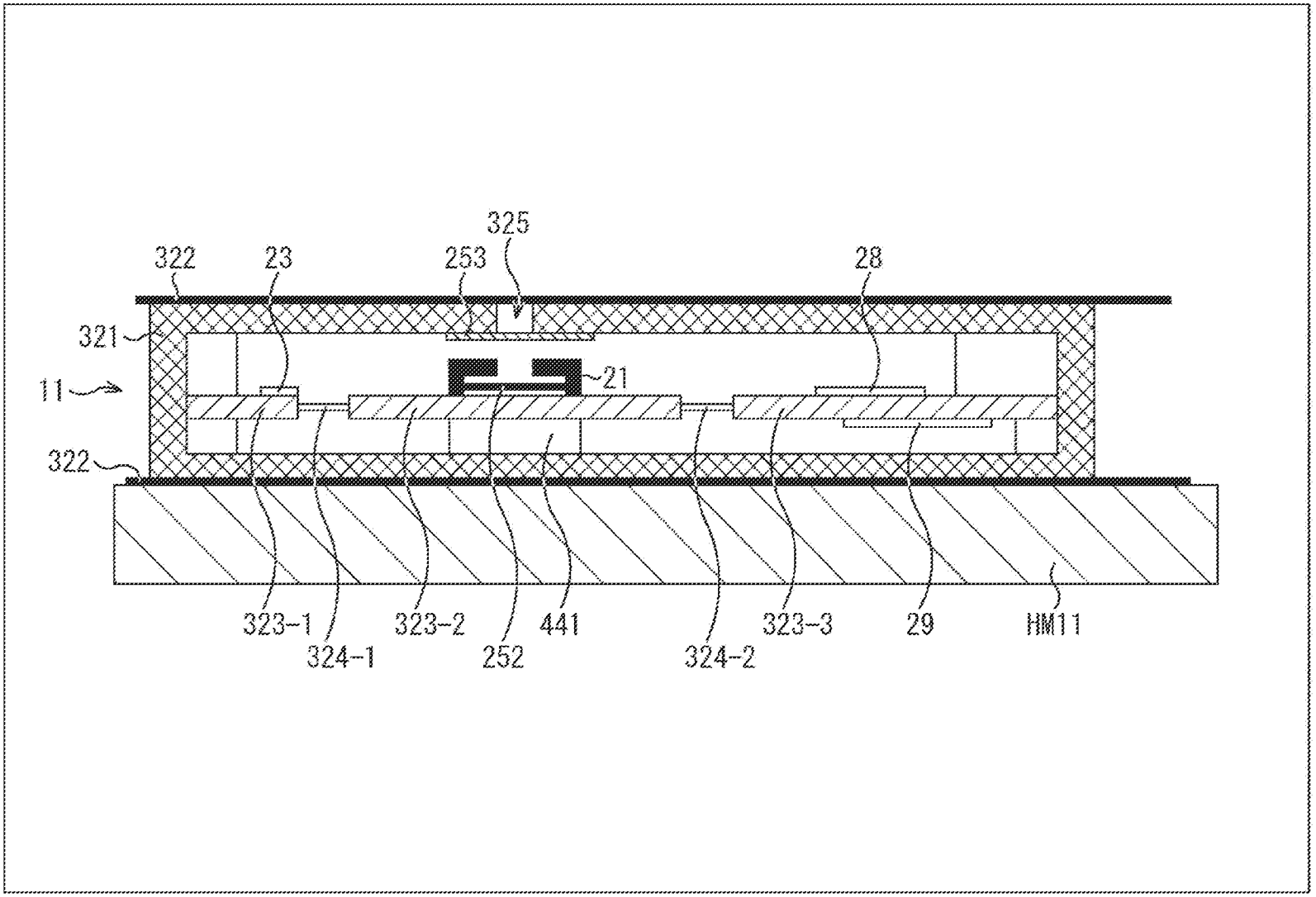
FIG. 17 is a diagram illustrating an example of the cross-sectional structure of the information processing apparatus.

In the example illustrated in FIG. 17, the microphone 21 is placed on the front surface of the board portion 323-2 similarly to the case of FIG. 16, but the vibration isolator 411 is not provided between the microphone 21 and the exterior portion 321.

However, in the example of FIG. 17, a vibration isolator 441 is provided between the back surface of the board portion 323-2 and the wearer HM11-side surface of the exterior portion 321 so that the board portion 323-2 and the microphone 21 are prevented from being greatly vibrated when the information processing apparatus 11 is vibrated.

The vibration isolator 441 as described above is placed so that the microphone 21 is prevented from being greatly vibrated when the information processing apparatus 11 is vibrated, and the mixing of noise sound can therefore be prevented.

In the information processing apparatus 11 configured as illustrated in FIG. 17, the distance from the microphone 21 to the waterproof sheet 253 is long enough to prevent the microphone 21 from being brought into contact with the waterproof sheet 253 when the entire information processing apparatus 11 is bent or vibrated. Further, the information processing apparatus 11 is designed so that the distance from the sound hole portion 325 to the diaphragm 252 is minimum.

The thickness of the information processing apparatus 11 in the vertical direction in FIG. 17 is desirably as small as possible, and the exterior portion 321 of the information processing apparatus 11 is flexible to some extent.

In addition, the board portion 323-2 is placed with play so that, when the entire information processing apparatus 11 is bent or vibrated, the board portion 323-2 can be freely vibrated in the amplitude range of vibration without being brought into contact with the exterior portion 321.

Figure 18:
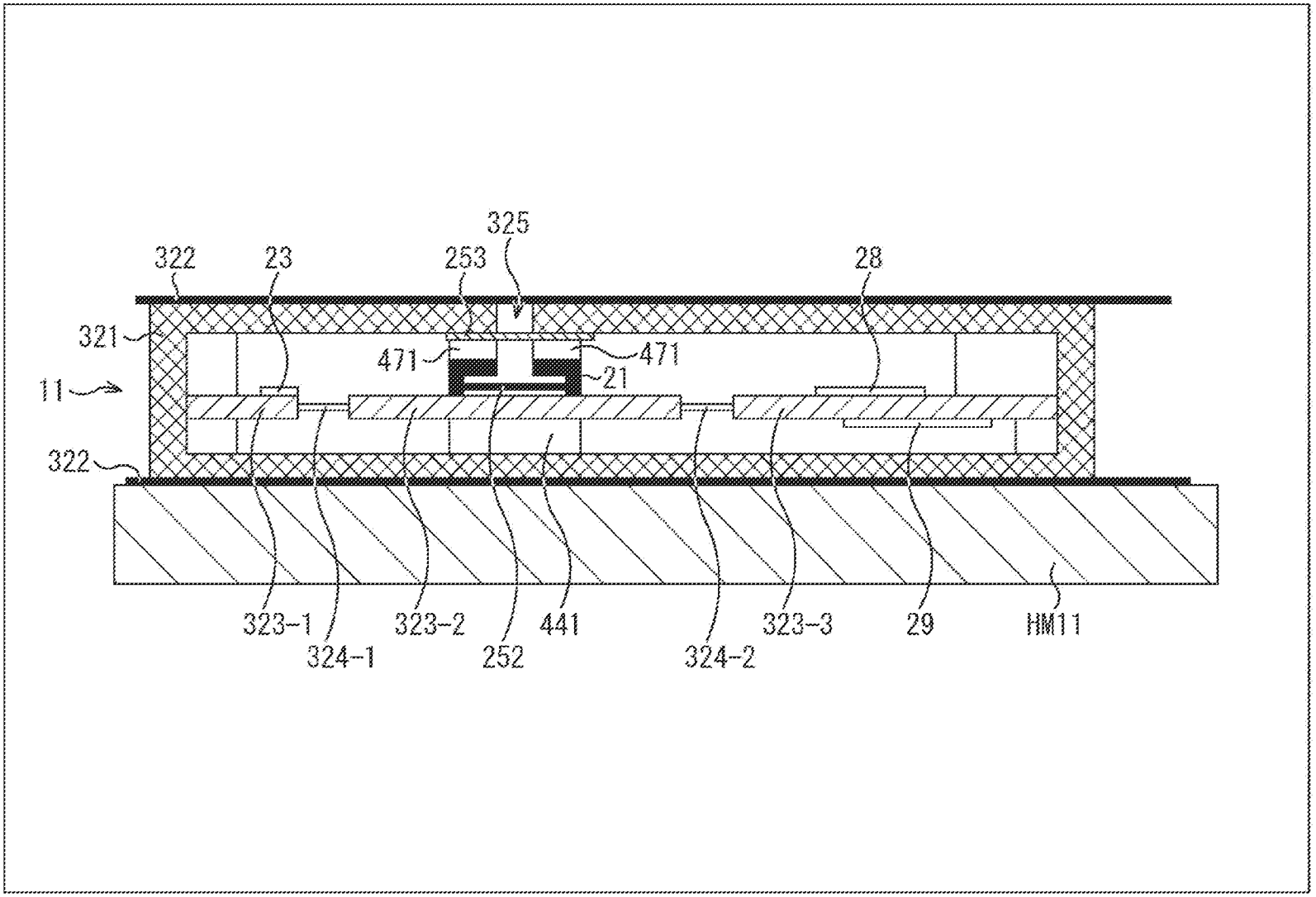
FIG. 18 is a diagram illustrating an example of the cross-sectional structure of the information processing apparatus.

In the example illustrated in FIG. 18, similarly to the case of FIG. 17, the microphone 21 is placed on the front surface of the board portion 323-2, and the vibration isolator 441 is provided between the back surface of the board portion 323-2 and the exterior portion 321.

In the example of FIG. 18, in addition to this, a vibration isolator 471 is placed on the exterior portion 321, more specifically, between the waterproof sheet 253 and the microphone 21.

Here, the distance from the microphone 21 to the waterproof sheet 253, that is, the thickness of the vibration isolator 471 is large enough to prevent the microphone 21 from being brought into contact with the waterproof sheet 253 or the exterior portion 321 when the entire information processing apparatus 11 is bent or vibrated.

The vibration isolator 441 and the vibration isolator 471 as described above are arranged so that the microphone 21 is prevented from being greatly vibrated when the information processing apparatus 11 is vibrated, and the mixing of noise sound can therefore be prevented.

The information processing apparatus 11 configured as illustrated in FIG. 18 is designed so that the distance from the sound hole portion 325 to the diaphragm 252 is minimum, and the thickness of the information processing apparatus 11 in the vertical direction in FIG. 18 is desirably as small as possible. Further, the exterior portion 321 of the information processing apparatus 11 is flexible to some extent.

In addition, the board portion 323-2 is placed with play so that, when the entire information processing apparatus 11 is bent or the information processing apparatus 11 is vibrated, the board portion 323-2 can be freely vibrated in the amplitude range of vibration without being brought into contact with the exterior portion 321.

Note that, in the examples illustrated in FIGS. 13 to 18, the description is made on the case where, to prevent the microphone 21 from being greatly vibrated, the vibration isolator is provided to at least one of the microphone 21 or the board portion 323 provided with the microphone 21 so that the vibration isolator is placed adjacent to the microphone 21 or the board portion 323.

Similarly to this, a vibration isolator may be placed adjacent to the position measurement unit 23, or the board portion having the position measurement unit 23 placed thereon. Meanwhile, for example, with regard to the 9-axis sensor 22, to achieve more accurate measurement, no vibration isolator is desirably placed at a portion adjacent to the 9-axis sensor 22, or the board portion having the 9-axis sensor 22 placed thereon.

Further, in the examples illustrated in FIGS. 13 to 18, the board portion of the rigid flexible board is divided into the three board portions 323, namely, the board portion 323-1 to the board portion 323-3, but the board portion may be divided into any number of portions as long as the board portion is divided into two or more.

In the case of a rigid flexible board having a configuration with two board portions, it is conceivable that the microphone 21 is mounted on one board portion farthest from the battery 26, and the main chip 29, the 9-axis sensor 22, the position measurement unit 23, and the communication unit 28 are mounted on the other board portion.

In such a case, for example, vibration isolation measures using the vibration isolator, which is described with reference to FIG. 13 or the like, can be taken against the microphone 21 and the board portion mounted with the microphone 21, with the result that the mixing of noise sound at the microphone 21 can be prevented.

Further, in the case of the rigid flexible board having the configuration with two board portions, it is conceivable that the position measurement unit 23 and the microphone 21 are mounted on one board portion farthest from the battery 26, and the main chip 29, the 9-axis sensor 22, and the communication unit 28 are mounted on the other board portion. In this case, the position measurement unit 23 can be placed at the position physically away from the battery 26 and the main chip 29.

In the case of a rigid flexible board having a configuration with three board portions, it is conceivable that the microphone 21 is mounted on the first board portion, the main chip 29, the 9-axis sensor 22, and the communication unit 28 are mounted on the second board portion, and the position measurement unit 23 is mounted on the third board portion.

In this case, the vibration isolation measures can be taken against the microphone 21 and the board portion mounted with the microphone 21, and the position measurement unit 23 can be placed at the position physically away from the second board portion and the battery 26.

In addition, in the case of a rigid flexible board having a configuration with four board portions, it is conceivable that the microphone 21 is mounted on the first board portion, the main chip 29 and the 9-axis sensor 22 are mounted on the second board portion, the position measurement unit 23 is mounted on the third board portion, and the communication unit 28 is mounted on the fourth board portion.

In this case, since the number of board portions is large, the bend tolerance of the rigid flexible board is increased as a whole, and the flexibility can therefore be enhanced. Further, the elements are arranged at the positions away from each other so that the mixing of electrical noise with the elements can be prevented.

<Other Examples of Board Configuration>

Figure 19:
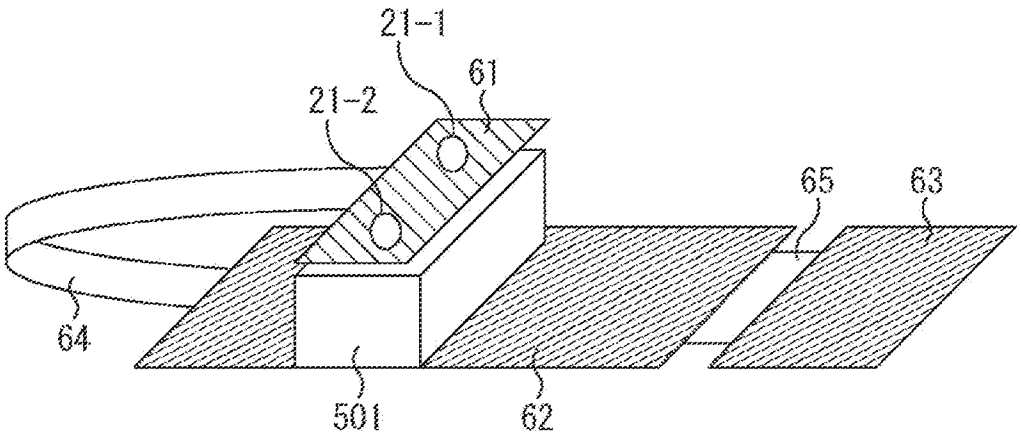
FIG. 19 is a diagram illustrating an arrangement example of board portions.
Figure 20:
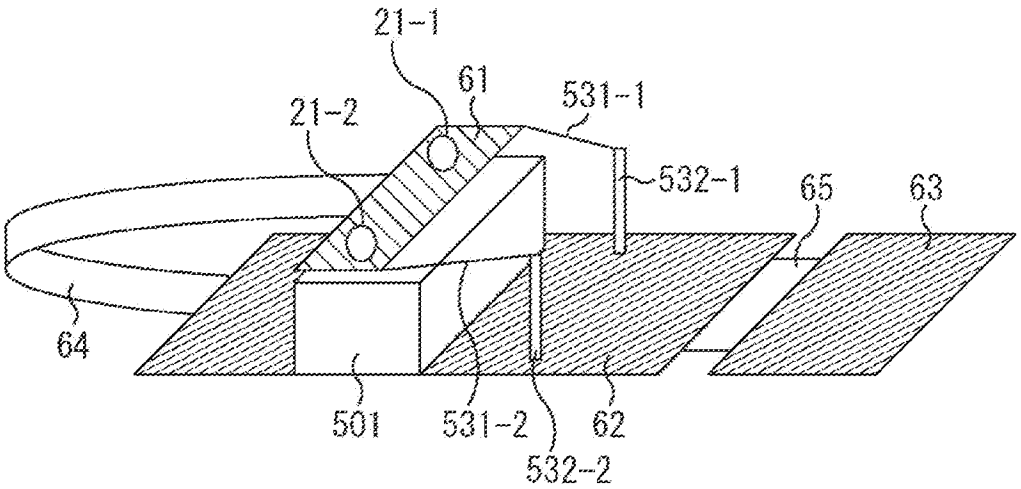
FIG. 20 is a diagram illustrating an arrangement example of the board portions.

Moreover, in the present technology, since the connection portions configured to connect the board portions to each other are flexible, for example, as illustrated in FIG. 19 and FIG. 20, the plurality of board portions can be arranged in the direction vertical to the board surfaces.

Note that, in FIG. 19 and FIG. 20, portions corresponding to the ones in the case of FIG. 3 are denoted by the same reference signs, and the descriptions are appropriately omitted. However, in FIG. 19 and FIG. 20, the illustrations of some elements illustrated in FIG. 3 are omitted. Further, in FIG. 19 and FIG. 20, corresponding portions are denoted by the same reference signs, and the descriptions are appropriately omitted.

In the example illustrated in FIG. 19, the connection portion 64 is bent so that the board portion 61 is positioned above the board portion 62 in FIG. 19. That is, in this example, the board portion 61 and the board portion 62 are arranged in the normal direction of the board surface of the board portion 62.

Further, a vibration isolator 501 such as a gel for vibration isolation is placed between the board portion 61 and the board portion 62. The microphone 21 is provided on the board portion 61. The vibration isolator 501 is placed between the board portion 61 and the board portion 62 so that the board portion 61 is prevented from being greatly vibrated, and the mixing of noise sound at the microphone 21 can therefore be prevented.

The rigid flexible board has the folded reversal structure in which the connection portion 64 is bent so that the board portion 61 is turned over to be placed above the board portion 62 as described above, with the result that the longitudinal width, that is, transverse width in FIG. 19 of the information processing apparatus 11 can be more reduced.

The rigid flexible board having the folded reversal structure is useful especially for, for example, a case where the information processing apparatus 11 is worn on the back of a wearer, and a case where the information processing apparatus 11 is a belt or a watch device and the rigid flexible board is provided to the belt (band) portion.

Note that, also in FIG. 19, the number of the microphones 21 provided on the board portion 61 is not limited to two, and any number of the microphones 21 may be provided.

Further, in the example illustrated in FIG. 20, the connection portion 64 is bent so that the board portion 61 is placed above the board portion 62 through the vibration isolator 501 similarly to the example illustrated in FIG. 19, but the board portion 61 is further connected to the board portion 62 by an elastic member 531-1 and an elastic member 531-2.

That is, in this example, the board portion 62 is provided with a post 532-1 and a post 532-2 that extend in the normal direction of the board surface of the board portion 62. Further, the post 532-1 and the post 532-2 are connected to the end of the board portion 61 by the elastic member 531-1 and the elastic member 531-2, and the board portion 61 is thus loosely fixed to the board portion 62.

Here, the elastic member 531-1 and the elastic member 531-2 each include, for example, an elastic stringy member (fiber) such as rubber string.

Note that, in the example illustrated in FIG. 20, the vibration isolator 501 is placed between the board portion 61 and the board portion 62, but as a matter of course, a configuration without the vibration isolator 501 can be employed. Further, also in this case, the number of the microphones 21 provided on the board portion 61 is not limited to two, and any number of microphones 21 may be provided.

Moreover, two or more board portions may be connected to one end of a board portion.

Figure 21:
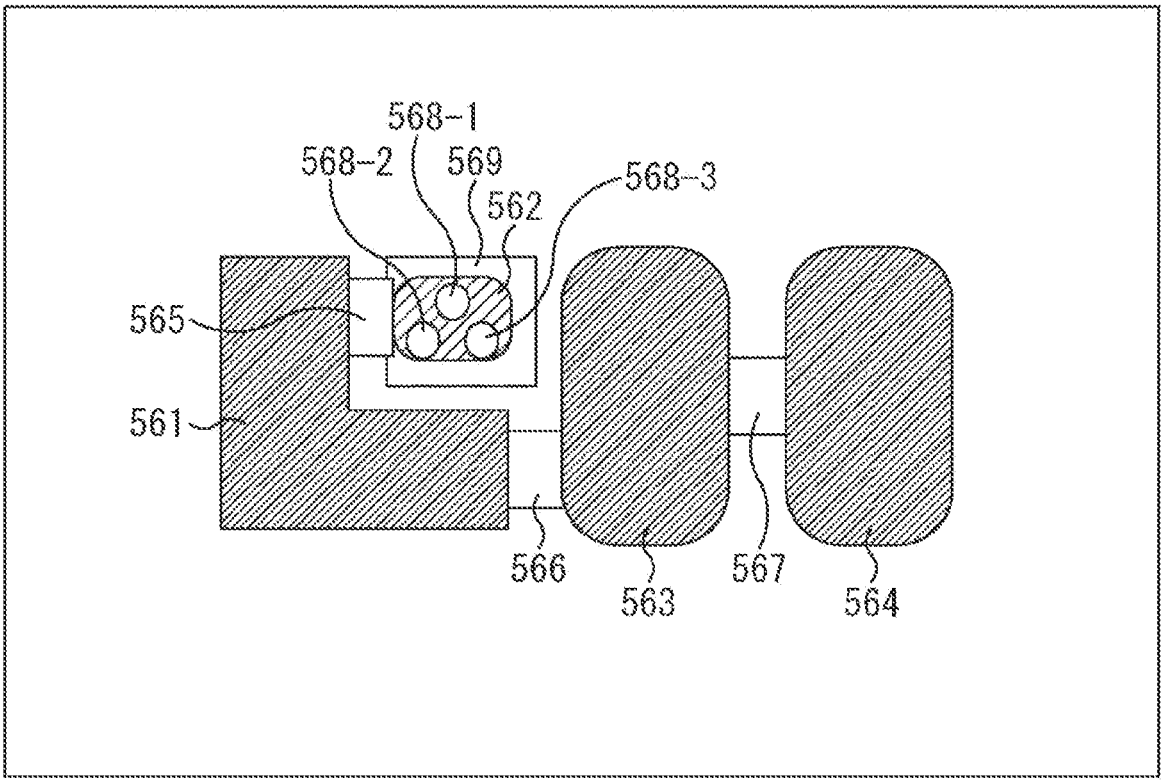
FIG. 21 is a diagram illustrating an arrangement example of board portions.

In such a case, the rigid flexible board of the information processing apparatus is configured as illustrated in FIG. 21, for example.

In the example illustrated in FIG. 21, the rigid flexible board of the information processing apparatus includes a board portion 561 to a board portion 564 and a connection portion 565 to a connection portion 567. Here, the board portion 561 to the board portion 564 correspond to the board portion 61, the board portion 62, and the like illustrated in FIG. 3, and the connection portion 565 to the connection portion 567 correspond to the connection portion 64 and the connection portion 65 illustrated in FIG. 3.

In this example, to the board portion 561 having a shape with a cut-out, the board portion 562 is connected through the connection portion 565, and three microphones 568-1 to 568-3 are arranged on the board portion 562.

The microphone 568-1 to the microphone 568-3 correspond to the microphone 21 illustrated in FIG. 1. Note that, in the following, in a case where there is no particular need to distinguish between the microphone 568-1 to the microphone 568-3, the microphone 568-1 to the microphone 568-3 are also simply referred to as "microphone 568."

Further, a vibration isolator 569 is placed between the board portion 562 provided with the microphone 568 and the exterior portion of the information processing apparatus, which is not illustrated. With this, the mixing of noise sound at the microphones 568 can be prevented.

Moreover, to the board portion 561, the board portion 563 is connected through the connection portion 566, and the board portion 564 is connected to the board portion 563 through the connection portion 567.

In particular, here, the two board portions 562 and 563 are connected to the right side of the board portion 561 in FIG. 21.

Note that, in FIG. 21, as elements mounted on the board portions, only the microphone 568 is illustrated, but in actuality, elements like the ones illustrated in FIG. 1 are arranged also on the board portion 561, the board portion 563, the board portion 564, and the like. Further, here, the example in which the three microphones 568 are provided is described, but any number of the microphones 568 may be provided.

Moreover, here, the vibration isolator 569 is provided adjacent to the board portion 562, but as a matter of course, a configuration without the vibration isolator 569 may be employed.

<Other Applications>

Moreover, the information processing apparatus 11 illustrated in FIG. 1 may include the box-like exterior portion 321 as illustrated in FIG. 13, or may be a watch or a wristband device.

Figure 22:
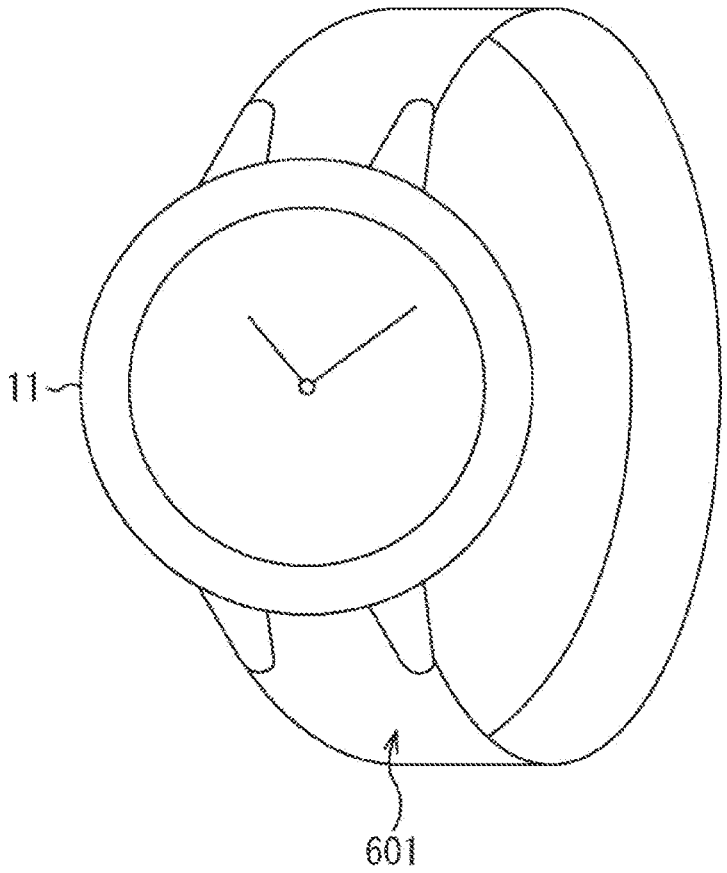
FIG. 22 is a diagram illustrating an appearance configuration example of the information processing apparatus.

For example, in the case where the information processing apparatus 11 is a watch device as illustrated in FIG. 22, the rigid flexible board is placed inside the portion or the like of a band 601 of the watch.

Figure 23:
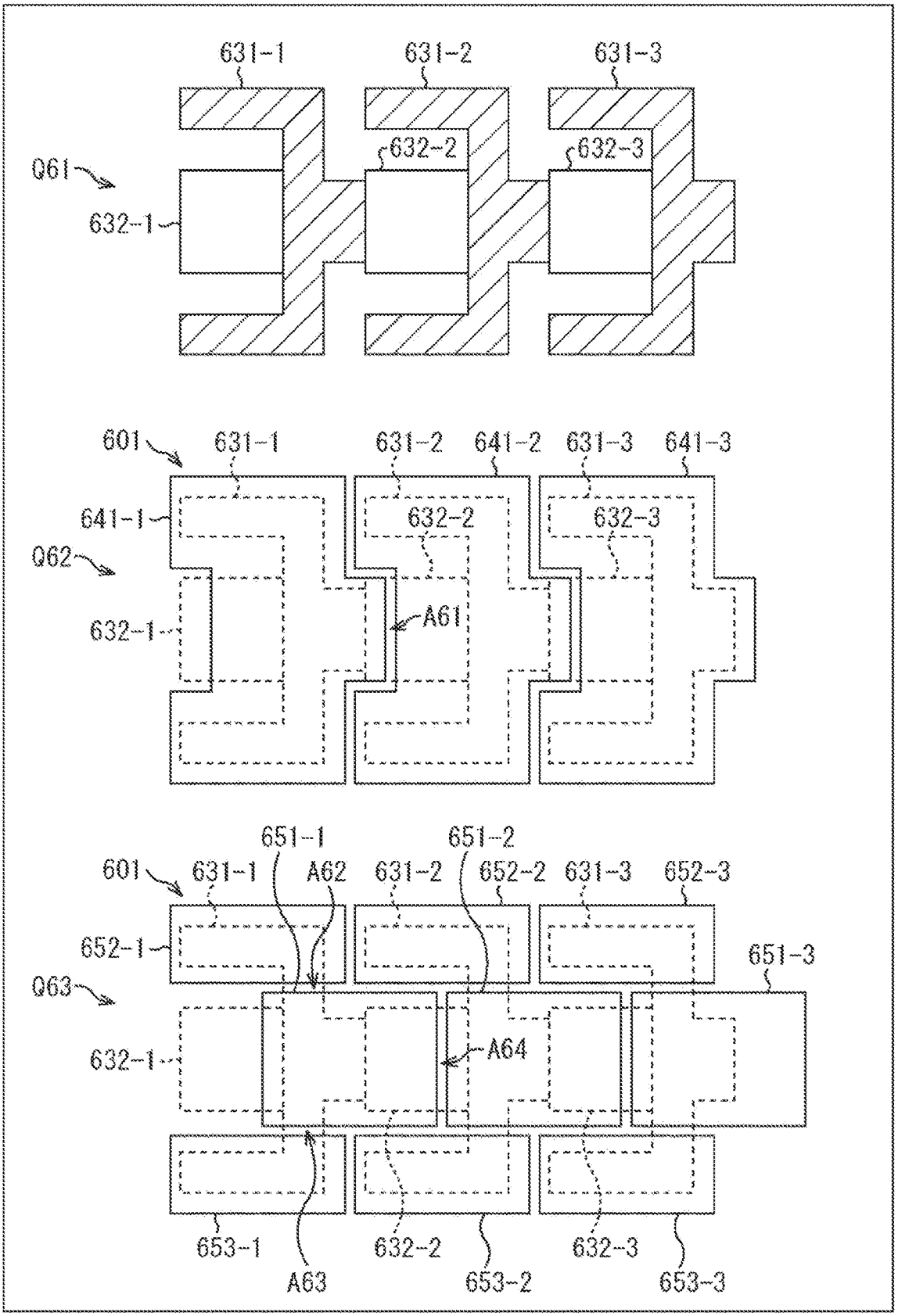
FIG. 23 is a diagram illustrating configuration examples of a band portion of the information processing apparatus.

Specifically, for example, as indicated by an arrow Q61 of FIG. 23, the information processing apparatus 11 of the rigid flexible board includes a board portion 631-1 to a board portion 631-3 and a connection portion 632-1 to a connection portion 632-3.

Note that, the board portion 631-1 to the board portion 631-3 correspond to the board portion 61 and the like illustrated in FIG. 3, for example, and the connection portion 632-1 to the connection portion 632-3 correspond to the connection portion 64 and the like illustrated in FIG. 3, for example. In the following, in a case where there is no particular need to distinguish between the board portion 631-1 to the board portion 631-3, the board portion 631-1 to the board portion 631-3 are also simply referred to as "board portion 631," and in a case where there is no particular need to distinguish between the connection portion 632-1 to the connection portion 632-3, the connection portion 632-1 to the connection portion 632-3 are also simply referred to as "connection portion 632."

In the portion indicated by the arrow Q61, the board portion 631-1 is connected to the board portion 631-2 by the connection portion 632-2, and the board portion 631-2 is connected to the board portion 631-3 by the connection portion 632-3.

In particular, in this example, since the rigid flexible board is placed inside the band 601, the connection portion 632 is moderately long so that a sufficient bend angle can be secured with the connection portion 632. Further, the connection portion 632 includes, for example, water-resistant polyimide, which is water resistant.

The band 601 configured to house the rigid flexible board including the board portion 631 and the connection portion 632 as described above may have any configuration, and a configuration indicated by an arrow Q62 and a configuration indicated by an arrow Q63 are conceivable, for example.

In the example indicated by the arrow Q62, the band 601 includes a piece 641-1 to a piece 641-3 that include metal or the like. Note that, in the following, in a case where there is no particular need to distinguish between the piece 641-1 to the piece 641-3, the piece 641-1 to the piece 641-3 are also simply referred to as "piece 641."

The piece 641 is disassemble into a front surface part and a back surface part, and has a hollow formed therein with the front surface part and the back surface part fitted to each other. Thus, the board portion 631 and the connection portion 632 can be housed in the space inside the piece 641.

In particular, in this example, one board portion 631 and most part of one connection portion 632 connected to the board portion 631 are housed inside the corresponding piece 641. Further, the pieces 641 are connected to each other by spring rods, which are not illustrated.

Note that, in the example indicated by the arrow Q62, the connection portion 632 is exposed at a portion between the adjacent pieces 641, for example, a portion indicated by an arrow A61, and hence the exposed portion may be covered with another member including an appropriate material.

Further, in the example indicated by the arrow Q63, the band 601 includes a piece 651-1 to a piece 651-3, a piece 652-1 to a piece 652-3, and a piece 653-1 to a piece 653-3 that include metal or the like.

Note that, in the following, in a case where there is no particular need to distinguish between the piece 651-1 to the piece 651-3, the piece 651-1 to the piece 651-3 are also simply referred to as "piece 651." Further, in the following, in a case where there is no particular need to distinguish between the piece 652-1 to the piece 652-3, the piece 652-1 to the piece 652-3 are also simply referred to as "piece 652," and in a case where there is no particular need to distinguish between the piece 653-1 to the piece 653-3, the piece 653-1 to the piece 653-3 are also simply referred to as "piece 653."

Similarly to the case of the piece 641, the piece 651 to the piece 653 are each disassemble into a front surface part and a back surface part, and each have a hollow formed therein with the front surface part and the back surface part fitted to each other.

In this example, one board portion 631 and most part of one connection portion 632 connected to the board portion 631 are housed inside the corresponding piece 651, piece 652, and piece 653. Further, the piece 651, the piece 652, and the piece 653 are connected to each other by spring rods, which are not illustrated.

For example, similarly to the pieces, the spring rods are each disassemble into a front surface part and a back surface part, and the board portion 631 can be partly housed between the front surface parts and the back surface parts.

In this case, for example, a portion of the board portion 631-1 near a position indicated by an arrow A62 is housed inside one spring rod, and the piece 651-1 is connected to the piece 652-1 by the spring rod.

In a similar manner, for example, a portion of the board portion 631-1 near a position indicated by an arrow A63 is housed inside one spring rod, and the piece 651-1 is connected to the piece 653-1 by the spring rod.

Further, similarly to the example indicated by the arrow Q62, a portion between the adjacent pieces 651, for example, a portion indicated by an arrow A64, may be covered with another member including an appropriate material.

On the board portion 631 of the rigid flexible board housed inside the band 601 as described above, any element such as the microphone 21, the 9-axis sensor 22, the position measurement unit 23, the recording unit 27, the communication unit 28, or the main chip 29 illustrated in FIG. 1 is mounted.

Besides, for example, on the board portion 631, a sphygmomanometer, a pedometer, a thermometer, a heart rate measurement element, or the like may be mounted as an acquisition unit configured to acquire information associated with the wearer. In this case, biological information such as blood pressure, body temperature, or heart rate, or how many steps the wearer has taken is acquired as information associated with the wearer.

Figure 24:
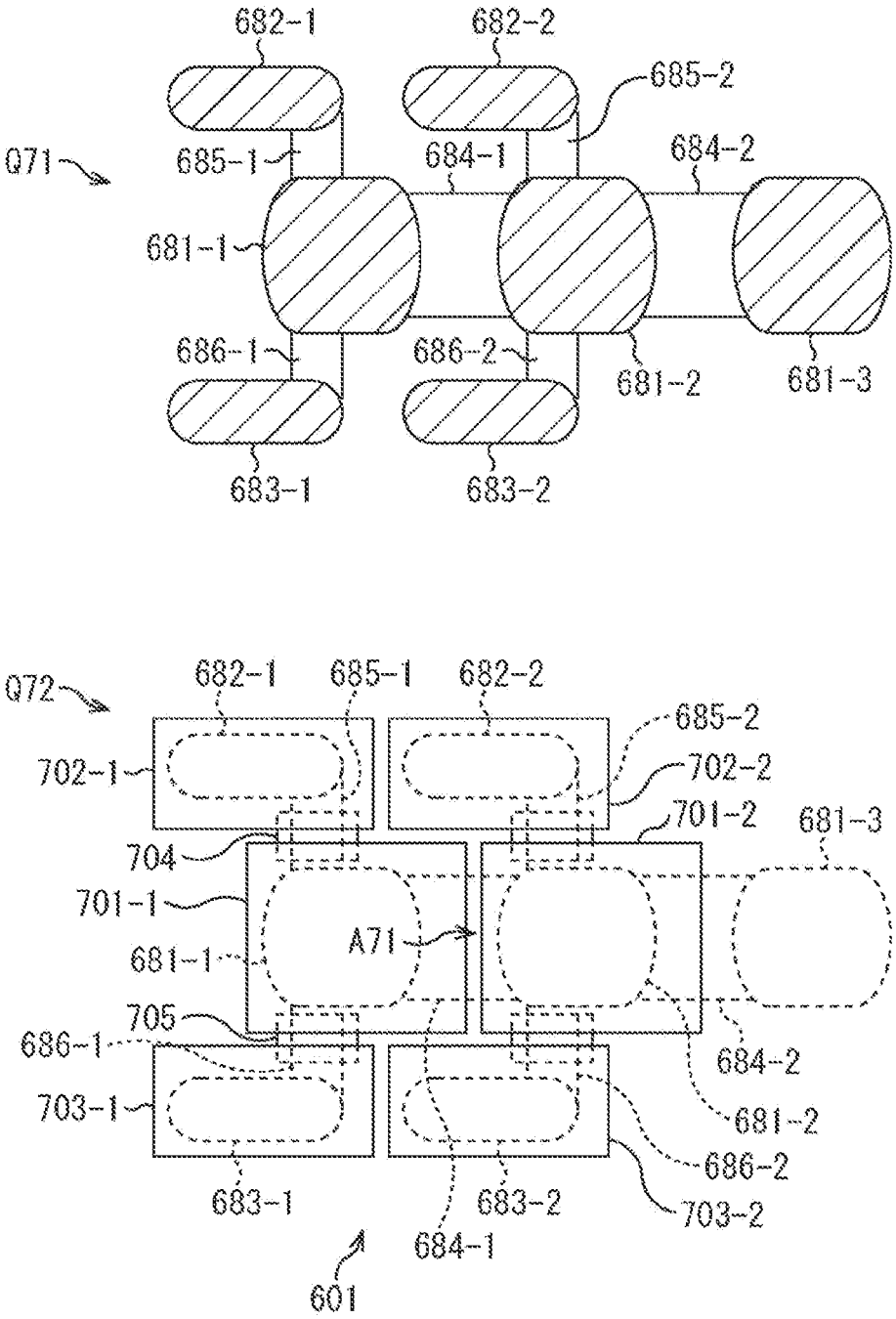
FIG. 24 is a diagram illustrating configuration examples of the band portion of the information processing apparatus.

Moreover, the rigid flexible board that is housed inside the band 601 may have a configuration indicated by an arrow Q71 of FIG. 24.

In the example indicated by the arrow Q71 of FIG. 24, the rigid flexible board includes a board portion 681-1 to a board portion 681-3, a board portion 682-1, a board portion 682-2, a board portion 683-1, a board portion 683-2, a connection portion 684-1, a connection portion 684-2, a connection portion 685-1, a connection portion 685-2, a connection portion 686-1, and a connection portion 686-2.

Note that, in the following, in a case where there is no particular need to distinguish between the board portion 681-1 to the board portion 681-3, the board portion 681-1 to the board portion 681-3 are also simply referred to as "board portion 681," and in a case where there is no particular need to distinguish between the board portion 682-1 and the board portion 682-2, the board portion 682-1 and the board portion 682-2 are also simply referred to as "board portion 682."

Further, in the following, in a case where there is no particular need to distinguish between the board portion 683-1 and the board portion 683-2, the board portion 683-1 and the board portion 683-2 are also simply referred to as "board portion 683," and in a case where there is no particular need to distinguish between the connection portion 684-1 and the connection portion 684-2, the connection portion 684-1 and the connection portion 684-2 are also simply referred to as "connection portion 684."

Moreover, in the following, in a case where there is no particular need to distinguish between the connection portion 685-1 and the connection portion 685-2, the connection portion 685-1 and the connection portion 685-2 are also simply referred to as "connection portion 685," and in a case where there is no particular need to distinguish between the connection portion 686-1 and the connection portion 686-2, the connection portion 686-1, and the connection portion 686-2 are also simply referred to as "connection portion 686."

Here, the board portion 681 to the board portion 683 correspond to the board portion 61 and the like illustrated in FIG. 3, for example, and the connection portion 684 to the connection portion 686 correspond to the connection portion 64 and the like illustrated in FIG. 3, for example.

In the example indicated by the arrow Q71, the board portions 681 arranged in the transverse direction in FIG. 24 are connected to each other by the connection portion 684 placed between the board portions 681. Further, the board portion 682 is connected on the upper side of the board portion 681 through the connection portion 685 in FIG. 24, and the board portion 683 is connected on the lower side of the board portion 681 through the connection portion 686 in FIG. 24.

In this example, since the rigid flexible board is placed inside the band 601, the connection portion 684 is moderately long so that a sufficient bend angle can be secured with the connection portion 684. Further, the connection portion 684 to the connection portion 686 include, for example, water-resistant polyimide, which is water resistant.

The band 601 configured to house the rigid flexible board as described above may have any configuration, and a configuration indicated by an arrow Q72 is conceivable, for example.

In the example indicated by the arrow Q72, the band 601 includes a piece 701-1, a piece 701-2, a piece 702-1, a piece 702-2, a piece 703-1, and a piece 703-2 that include metal or the like.

Note that, in the following, in a case where there is no particular need to distinguish between the piece 701-1 and the piece 701-2, the piece 701-1 and the piece 701-2 are also simply referred to as "piece 701." Further, in the following, in a case where there is no particular need to distinguish between the piece 702-1 and the piece 702-2, the piece 702-1 and the piece 702-2 are also simply referred to as "piece 702," and in a case where there is no particular need to distinguish between the piece 703-1 and the piece 703-2, the piece 703-1 and the piece 703-2 are also simply referred to as "piece 703."

Similarly to the case of the piece 641, the piece 701 to the piece 703 are each disassemble into a front surface part and a back surface part, and each have a hollow formed therein with the front surface part and the back surface part fitted to each other.

In this example, one board portion 681 is housed inside one piece 701, one board portion 682 is housed inside one piece 702, and one board portion 683 is housed inside one piece 703.

Further, the piece 701 is connected to the piece 702 and the piece 703 by respective spring rods.

For example, the piece 701-1 is connected to the piece 702-1 by a spring rod 704, and the piece 701-1 is connected to the piece 703-1 by a spring rod 705.

The spring rod 704 and the spring rod 705 are each disassemble into a front surface part and a back surface part, and the connection portions can be partly housed between the front surface parts and the back surface parts. In particular, here, the connection portion 685-1 is partly housed inside the spring rod 704, and the connection portion 686-1 is partly housed inside the spring rod 705.

Further, similarly to the example indicated by the arrow Q62, a portion between the adjacent pieces 701, for example, a portion indicated by an arrow A71, may be covered with another member including an appropriate material.

As described above, according to the present technology, the board portions are connected to each other by the flexible connection portions so that high comfortability can be obtained.

For example, in reproducing sound fields at free viewpoints, for example, bird's-eye views or walkthrough views, it is important to record target sound that is sound to be recorded, such as human's voice or motion sound made by a player such as ball kick sound, at a high SN ratio (Signal to Noise ratio). Further, in this case, position information regarding each sound source is required.

It is generally difficult to acquire, while recording target sound at a high SN ratio, an accurate position information regarding the sound source or the like. Further, for example, it is also difficult to record target sound inside a large field from outside the field at a high SN ratio due to the limits of devices.

Meanwhile, in the information processing apparatus to which the present technology is applied, high quality sound information can be recorded at a high SN ratio by the microphone 21, which is illustrated in FIG. 1, for example, and position information and motion information regarding a sound source, that is, a wearer can be acquired at a high SN ratio by the position measurement unit 23, the 9-axis sensor 22, and the like.

That is, with regard to sound information, the vibration isolation structure including the vibration isolator 326 as in the example illustrated in FIG. 13, for example, is employed so that the mixing of noise due to the body motion of the wearer or the like can be minimized, and sound information can be obtained at a high SN ratio.

Further, with regard to position information, the position measurement unit 23 is placed on the board portion 61 away from the battery 26 and the main chip 29 as illustrated in FIG. 8, for example, or separates power supply circuits are provided for the position measurement unit 23 and the remaining elements so that the mixing of power supply noise with the position measurement unit 23 can be prevented.

Moreover, for example, the board portions are connected to each other by the connection portions as illustrated in FIG. 3 and the like, and the deformable portions are provided to the exterior portion as illustrated in FIG. 9 so that the rigid flexible board and the exterior portion can secure a sufficient bend angle.

With this, as the shape of the information processing apparatus to which the present technology is applied, a suitable shape depending on the shape of a wearing surface that is a curved surface can be taken. As a result, the effect of the body motion of a wearer on the acquisition of sound information, position information, or motion information can be reduced. That is, when the information processing apparatus to which the present technology is applied is worn on a wearer, sound information, position information, and motion information associated with the wearer can be positively acquired at a robustly high SN ratio.

Note that, the embodiments of the present technology is not limited to the embodiments described above, and various modifications can be made within the scope of the gist of the present technology.

Moreover, the present technology can take the following configurations.

(1)

An information processing apparatus, including:

a plurality of board portions;

an acquisition unit placed on one of the board portions and configured to acquire information associated with a wearer; and a connection portion being flexible and configured to connect the board portion to another of the board portions.

(2)

The information processing apparatus according to (1), in which the connection portion includes a flexible printed board.

(3)

The information processing apparatus according to (1) or (2), in which the board portion has a recess portion, and the connection portion is connected to a portion, opposite to the other of the board portions, of the recess portion.

(4)

The information processing apparatus according to any one of (1) to (3), in which the acquisition unit includes a microphone.

(5)

The information processing apparatus according to (4), further including:

a vibration isolator placed adjacent to the board portion having the acquisition unit placed thereon, or the acquisition unit.

(6)

The information processing apparatus according to (5), in which the acquisition unit is placed on, of three of the board portions arranged, the board portion at a center.

(7)

The information processing apparatus according to (5), in which the acquisition unit is placed on, of three of the board portions arranged, the board portion at an end.

(8)

The information processing apparatus according to any one of (4) to (7), in which a tapered sound hole portion is formed in a portion, opposite to the acquisition unit, of an exterior portion of the information processing apparatus.

(9)

The information processing apparatus according to any one of (1) to (5), in which the board portion is placed such that the board portion and the other of the board portions are arranged in a normal direction of a board surface of the other of the board portions.

(10)

The information processing apparatus according to (9), in which a vibration isolator is placed between the board portion and the other of the board portions.

(11)

The information processing apparatus according to (9) or (10), in which the board portion is connected to the other of the board portions by an elastic member.

(12)

The information processing apparatus according to any one of (1) to (11), further including:

a recording unit configured to record information.

(13)

The information processing apparatus according to any one of (1) to (12), further including:

a communication unit placed on one of the board portions and configured to communicate with an external apparatus.

REFERENCE SIGNS LIST

11 Information processing apparatus, 21-1, 21-2, 21 Microphone, 22 9-axis sensor, 23 Position measurement unit, 28 Communication unit, 29 Main chip, 61 Board portion, 62 Board portion, 63 Board portion, 64 Connection portion, 65 Connection portion

The invention claimed is:

1. An information processing apparatus, comprising:

a plurality of board portions, wherein a first board portion of the plurality of board portions comprises at least one inflexible layer and a first portion of at least one flexible layer;

an acquisition unit on the first board portion, wherein the acquisition unit is configured to acquire information associated with a wearer of the information processing apparatus; and a connection portion configured to connect the first board portion to a second board portion of the plurality of board portions, wherein the connection portion comprises a second portion of the at least one flexible layer, and the first portion of the at least one flexible layer is different from the second portion of the at least one flexible layer.

2. The information processing apparatus according to claim 1, wherein the connection portion comprises a flexible printed board.

3. The information processing apparatus according to claim 1, wherein the first board portion has a recess portion, and the connection portion is connected to a portion, opposite to the second board portion, of the recess portion.

4. The information processing apparatus according to claim 1, wherein the acquisition unit comprises a microphone.

5. The information processing apparatus according to claim 4, further comprising a vibration isolator adjacent to the first board portion.

6. The information processing apparatus according to claim 5, wherein the first board portion is at a center of an arrangement of the plurality of board portions.

7. The information processing apparatus according to claim 5, wherein the first board portion is at an end of a linear arrangement of the plurality of board portions.

8. The information processing apparatus according to claim 4, wherein a tapered sound hole portion is in a portion, opposite to the acquisition unit, of an exterior portion of the information processing apparatus.

9. The information processing apparatus according to claim 1, wherein the first board portion the second board portion are arranged orthogonally with each other.

10. The information processing apparatus according to claim 9, further comprising a vibration isolator between the first board portion and the second board portion.

11. The information processing apparatus according to claim 9, wherein the first board portion is connected to the second board portion via an elastic member.

12. The information processing apparatus according to claim 1, further comprising a recording unit configured to record the information.

13. The information processing apparatus according to claim 1, further comprising a communication unit on at least one board portion of the plurality of board portions, wherein the communication unit is configured to communicate with an external apparatus.

* * * * *